US011006789B2

(12) United States Patent
Yeo

(10) Patent No.: US 11,006,789 B2
(45) Date of Patent: May 18, 2021

(54) DISPENSER FOR PROVIDING HYGIENIC PROTECTION OF HANDS WHEN USING A FUEL PUMP

(71) Applicant: Oliver Yeo, Devon (GB)

(72) Inventor: Oliver Yeo, Devon (GB)

( * ) Notice: Subject to any disclaimer, the term of this patent is extended or adjusted under 35 U.S.C. 154(b) by 199 days.

(21) Appl. No.: 16/086,174

(22) PCT Filed: Mar. 30, 2017

(86) PCT No.: PCT/IB2017/051830

§ 371 (c)(1),
(2) Date: Sep. 18, 2018

(87) PCT Pub. No.: WO2017/168367

PCT Pub. Date: Oct. 5, 2017

(65) Prior Publication Data

US 2020/0268219 A1 Aug. 27, 2020

(30) Foreign Application Priority Data

Apr. 1, 2016 (GB) ..... 1605559

(51) Int. Cl.
*A47K 10/38* (2006.01)
*A47K 10/42* (2006.01)
(Continued)

(52) U.S. Cl.
CPC ..... *A47K 10/3827* (2013.01); *A47K 10/424* (2013.01); *B65D 83/08* (2013.01);
(Continued)

(58) Field of Classification Search
CPC ..... E01H 2001/128
See application file for complete search history.

(56) References Cited

U.S. PATENT DOCUMENTS 6,783,028 B1 * 8/2004 Ambrose ..... B67D 7/426 141/392
6,789,695 B1 * 9/2004 Gaudreau ..... A47K 10/424 206/449

(Continued)

FOREIGN PATENT DOCUMENTS

DE 296 18 181 U1 12/1996
JP 53-118113 U 2/1952

(Continued)

OTHER PUBLICATIONS

International Searching Authority, International Search Report, PCT/IB2017/051830, dated Sep. 18, 2017.

(Continued)

*Primary Examiner* — Timothy R Waggoner
(74) *Attorney, Agent, or Firm* — Mark C. Reichel; Natalie J. Dean; Reichel Stohry Dean LLP

(57) ABSTRACT

When filling a vehicle with fuel, a person must touch and hold the dispenser nozzle by the handle 11, squeezing the trigger lever 13. This handle 11 is contaminated by fuel vapour, residue, bacteria, dirt and contaminants by previous usage of multiple persons touching and holding the handle 11 with contaminated hands. The present invention relates to a protective material dispenser 101 with protective material 103 therein, which is releasably couplable to such a fuel gun 2. In this way, a user may easily retrieve some of the protective material 103 from the dispenser 101 prior to touching the fuel pump hand grip 11, and then cover the hand grip 11 to protect his/her hands from making direct contact therewith.

8 Claims, 23 Drawing Sheets

(51) Int. Cl.

| | |
|---|---|
| ***B65D 83/08*** | (2006.01) |
| ***B67D 7/42*** | (2010.01) |
| *A47K 10/32* | (2006.01) |

(52) U.S. Cl.
CPC ..... *B67D 7/421* (2013.01); *B67D 7/426* (2013.01); *A47K 2010/3246* (2013.01)

(56) References Cited

U.S. PATENT DOCUMENTS

| | | | | |
|---|---|---|---|---|
| 8,777,064 | B2 * | 7/2014 | Williams | A61L 2/18 16/412 |
| 2009/0200329 | A1 * | 8/2009 | Balkin | A47K 17/003 221/45 |

FOREIGN PATENT DOCUMENTS

| | | | |
|---|---|---|---|
| JP | 03-040120 | | 4/1991 |
| JP | 2004-350711 | A | 12/2004 |
| JP | 2015-515293 | A | 5/2015 |
| WO | 99/05951 | A1 | 2/1999 |
| WO | 2008/090539 | A2 | 7/2008 |

OTHER PUBLICATIONS

International Searching Authority, Written Opinion of the International Searching Authority, PCT/IB2017/051830, dated Sep. 18, 2017.
International Searching Authority, International Preliminary Report on Patentability, PCT/IB2017/051830, dated May 3, 2018.
Notice of Reasons for Refusal for Japanese Patent Application 2018-549829, Japanese Patent Office, Dec. 21, 2020.

* cited by examiner

[Fig. 1a]
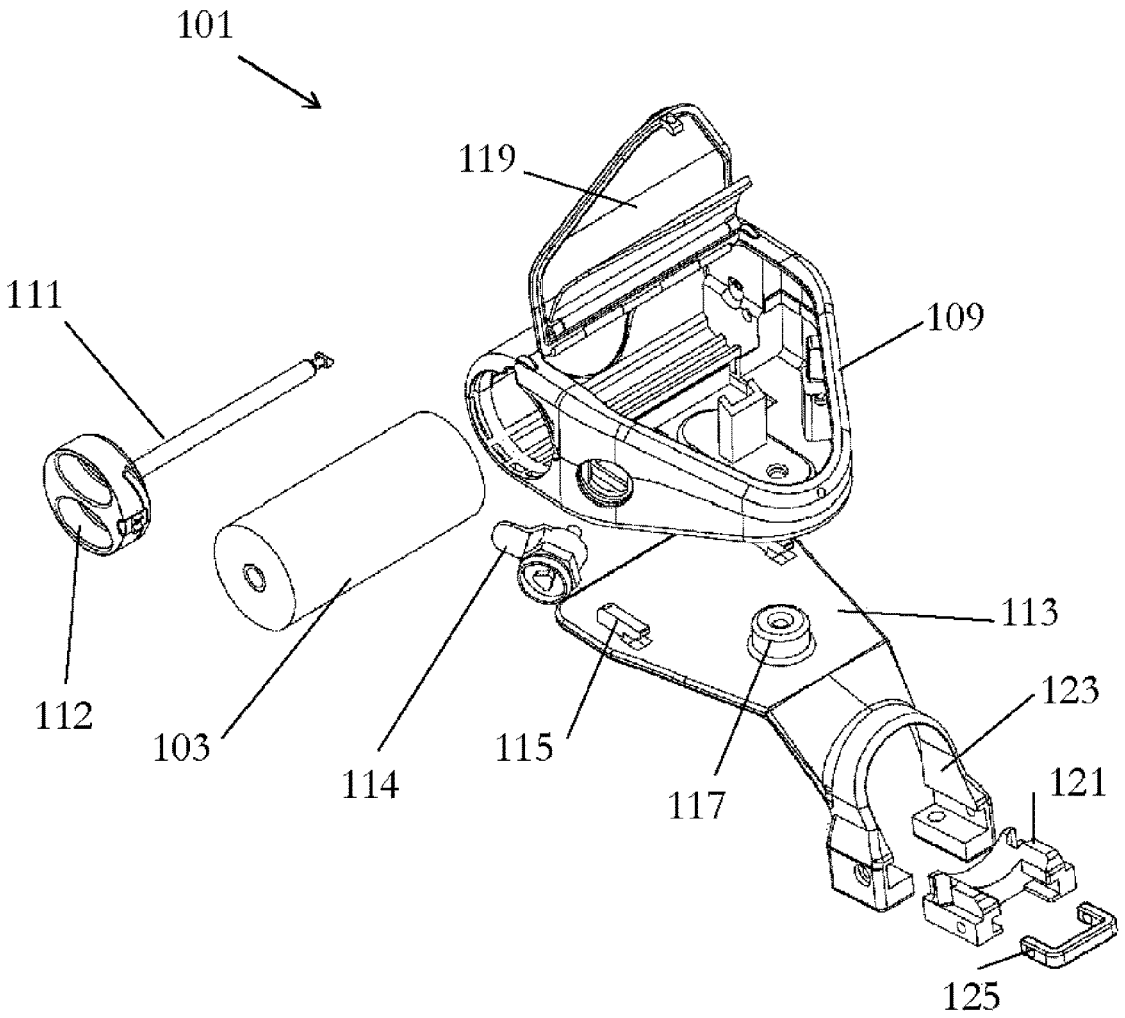
[Fig. 1b]
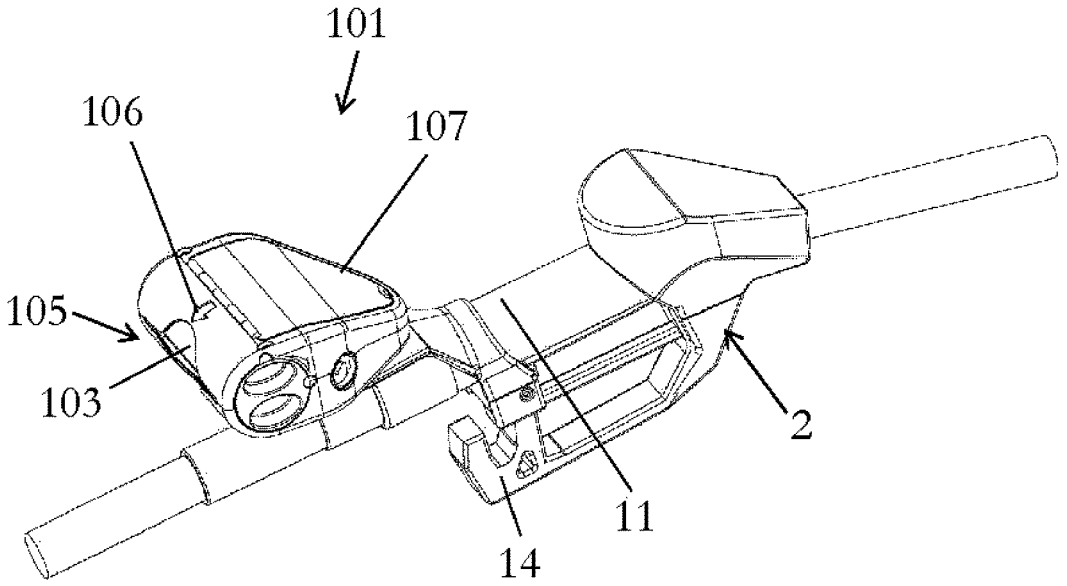

[Fig. 1c]
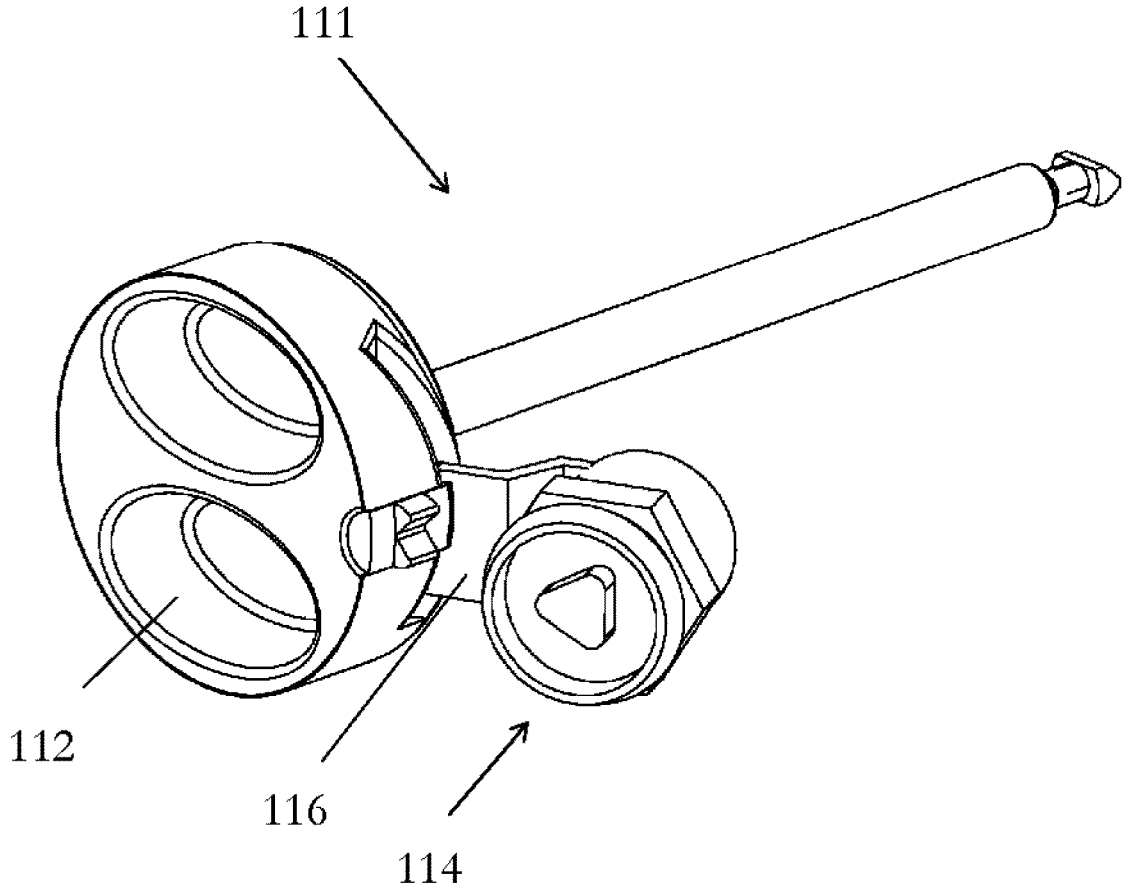
[Fig. 1d]
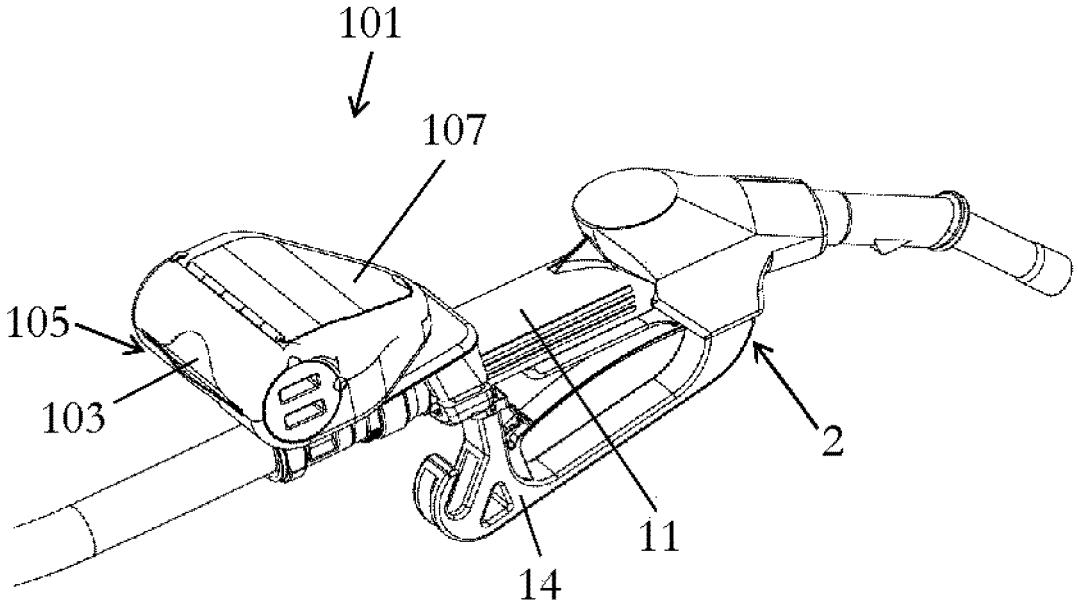

[Fig. 1e]
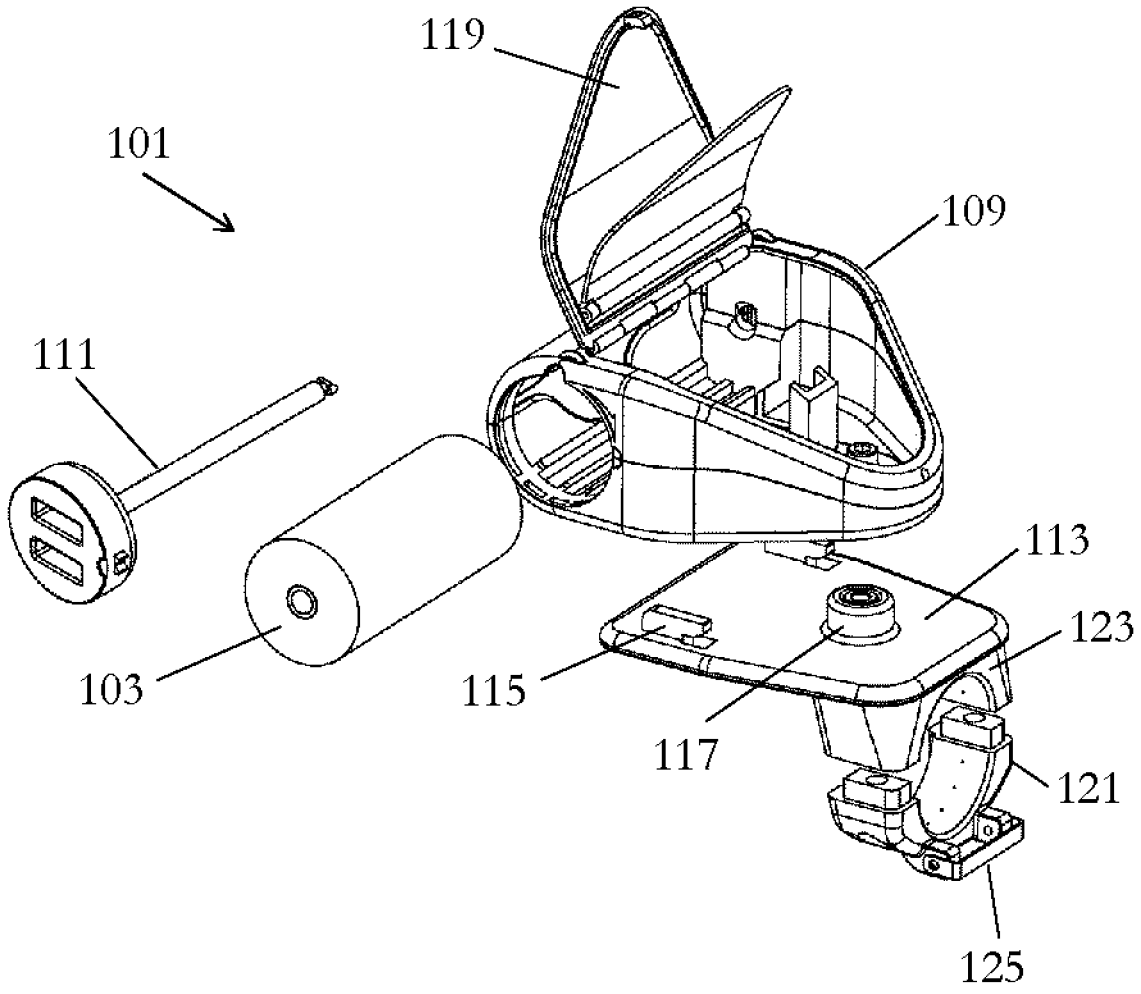

[Fig. 2a]
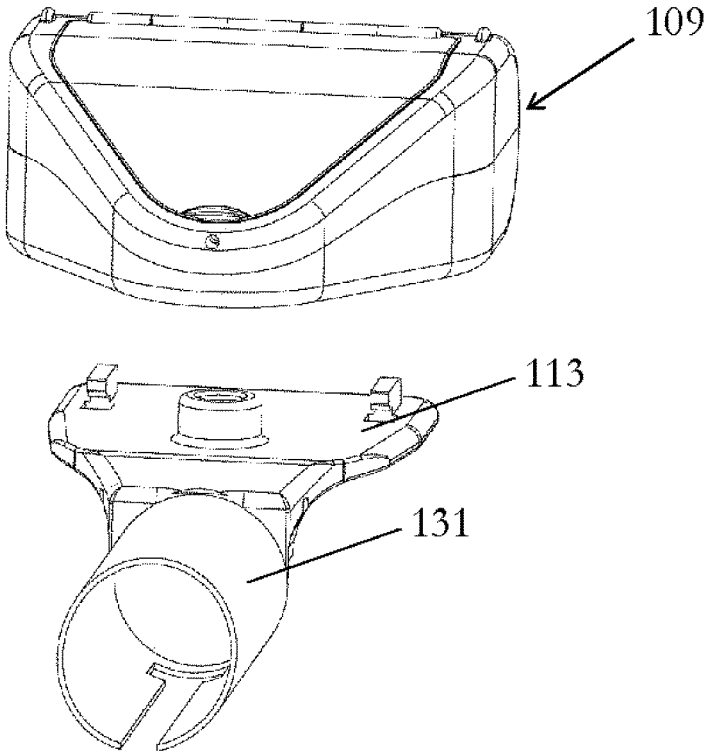
[Fig. 2b]
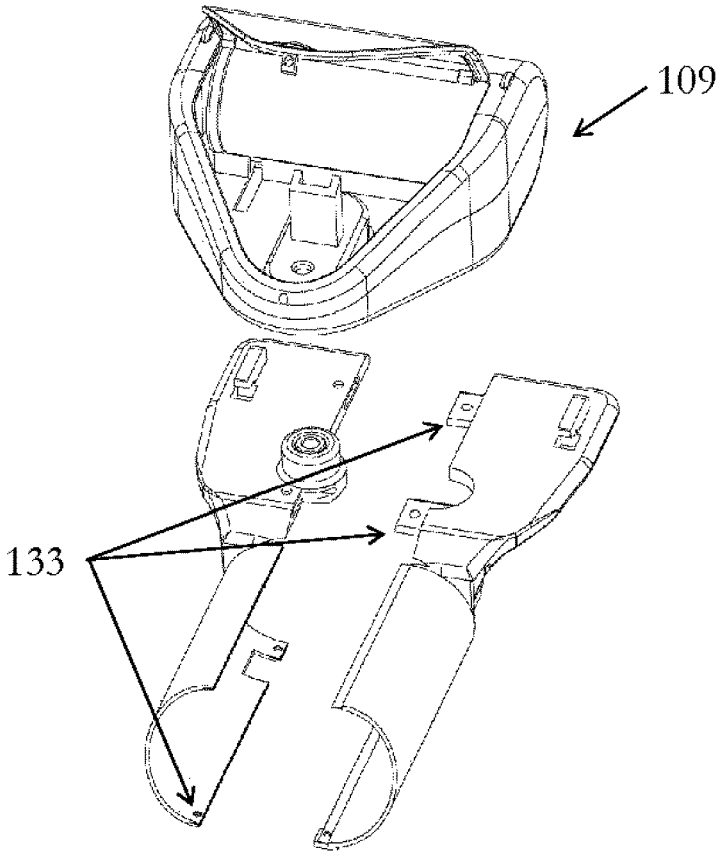

[Fig. 3]
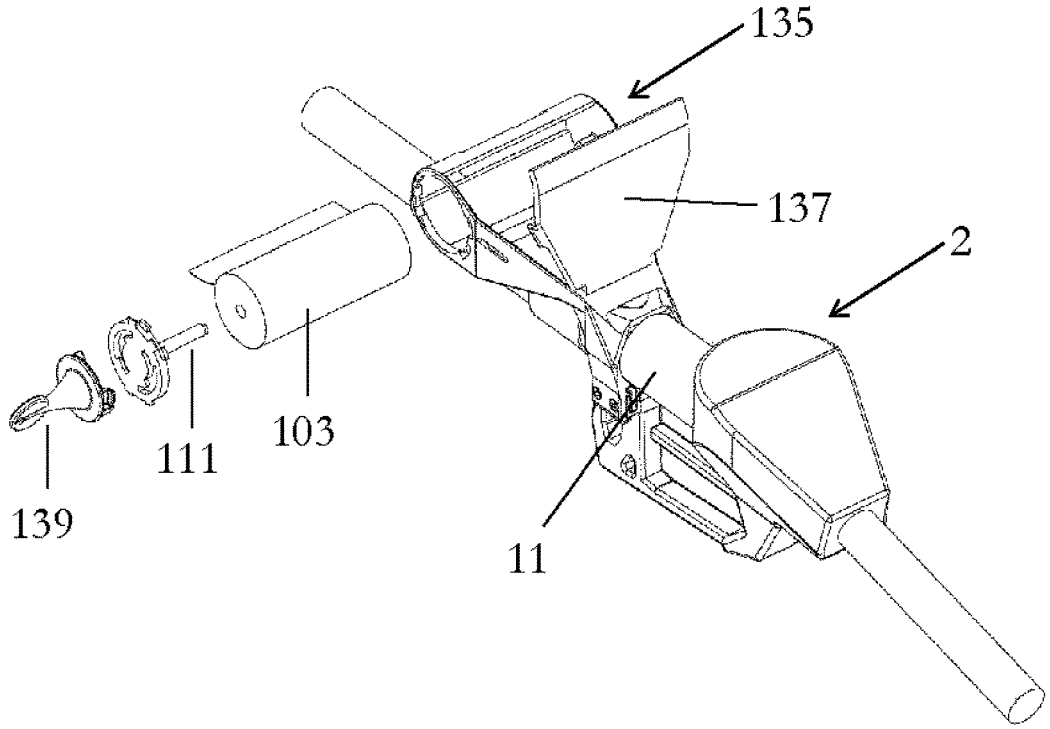
[Fig. 4]
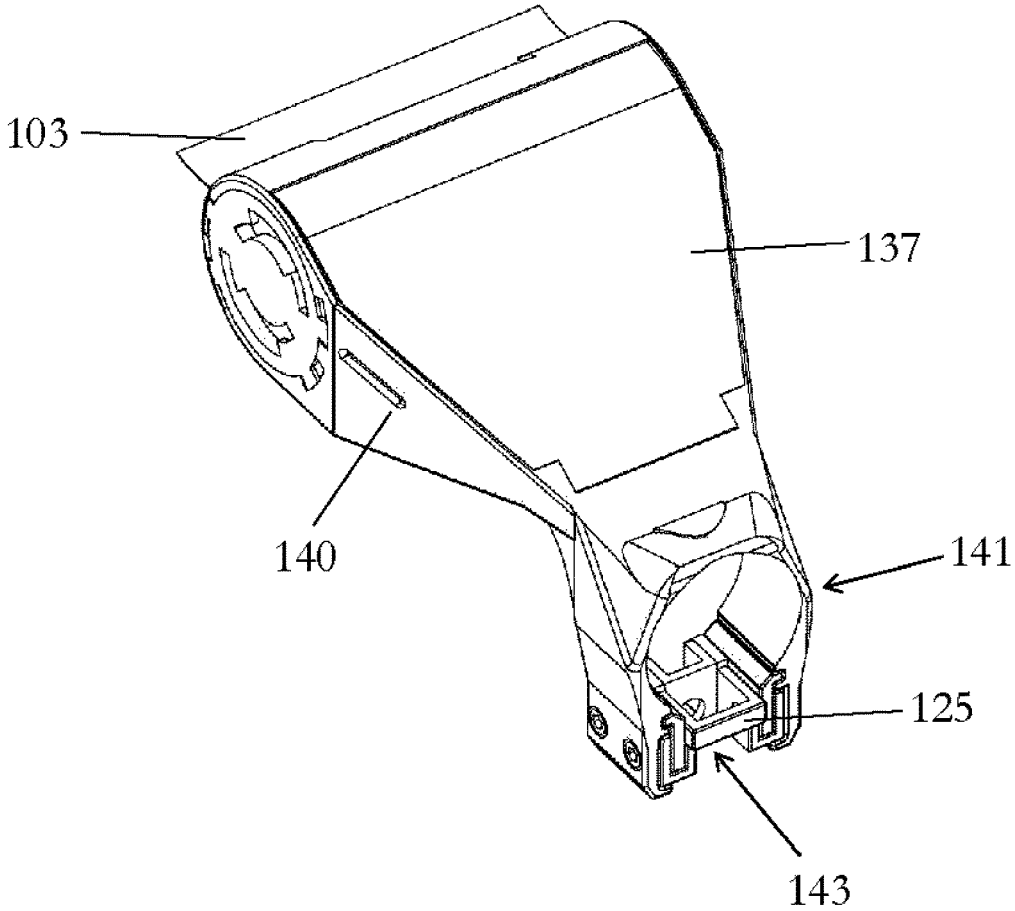

[Fig. 5]
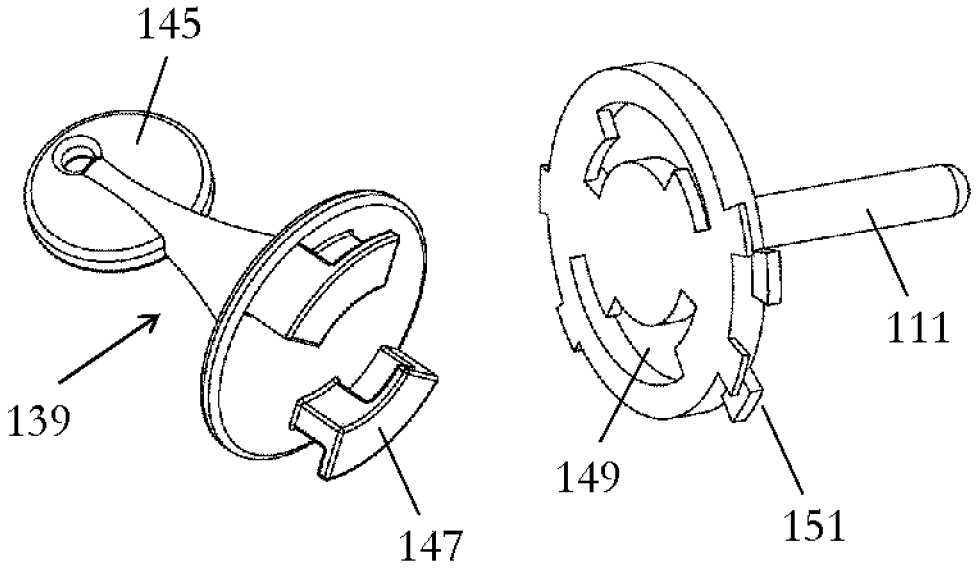
[Fig. 6]
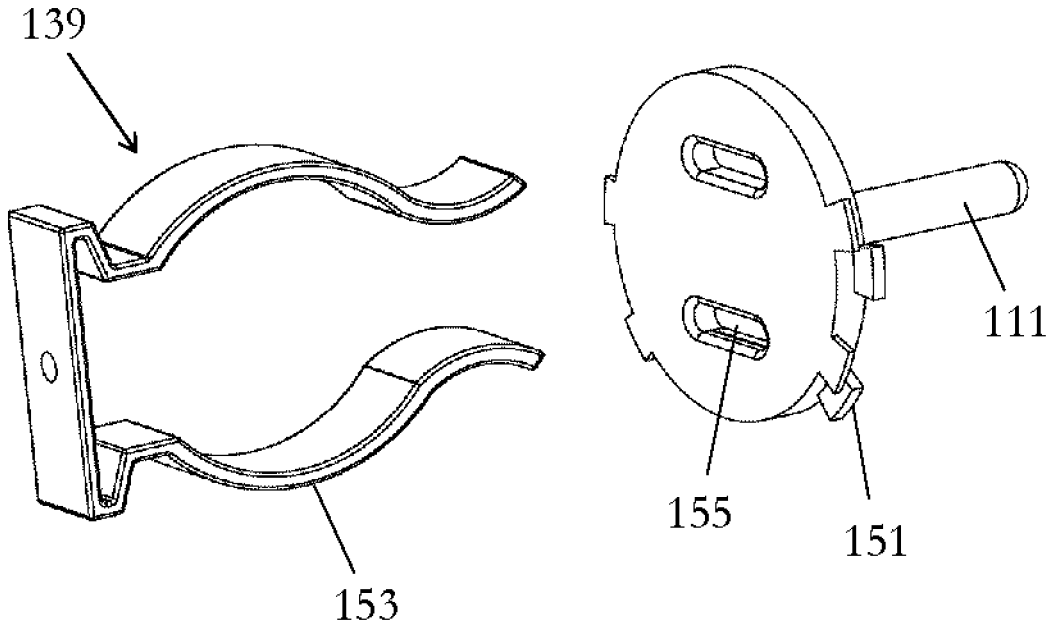

[Fig. 7]
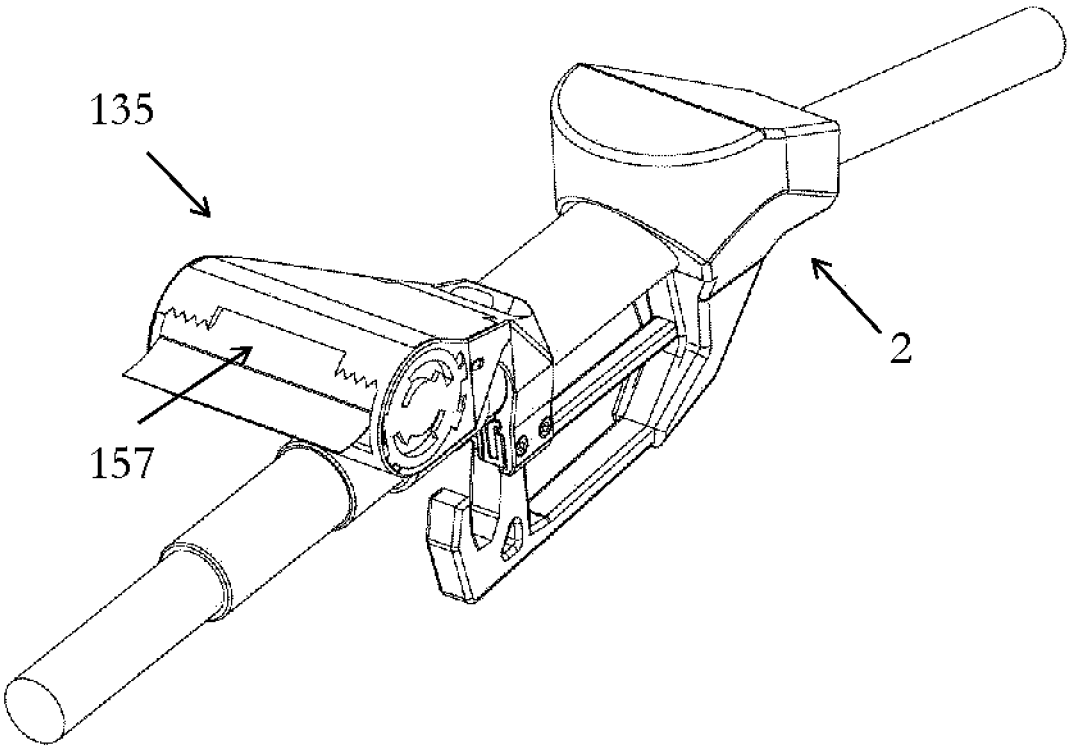
[Fig. 8]
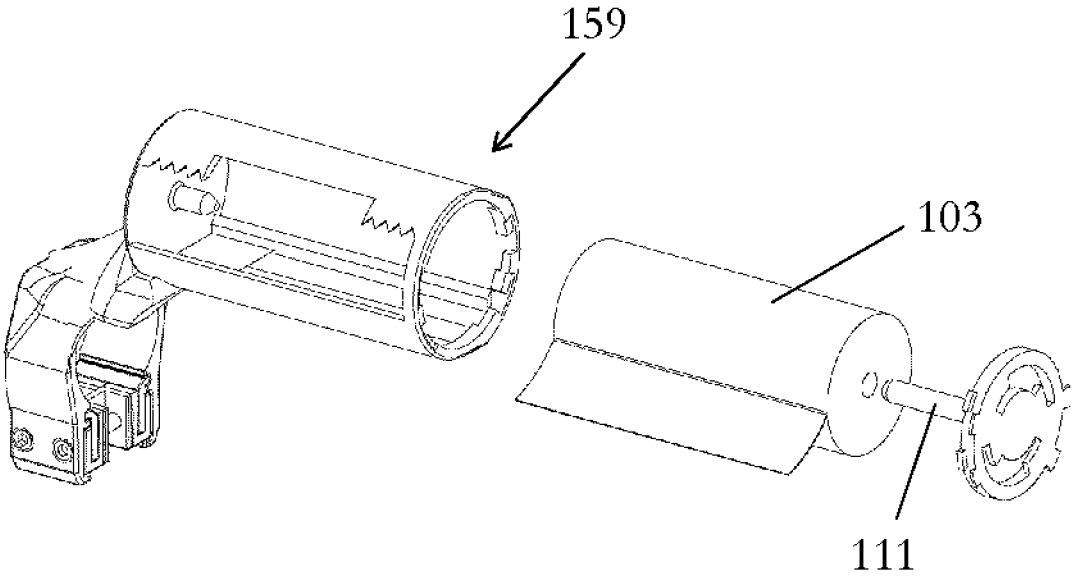

[Fig. 9]
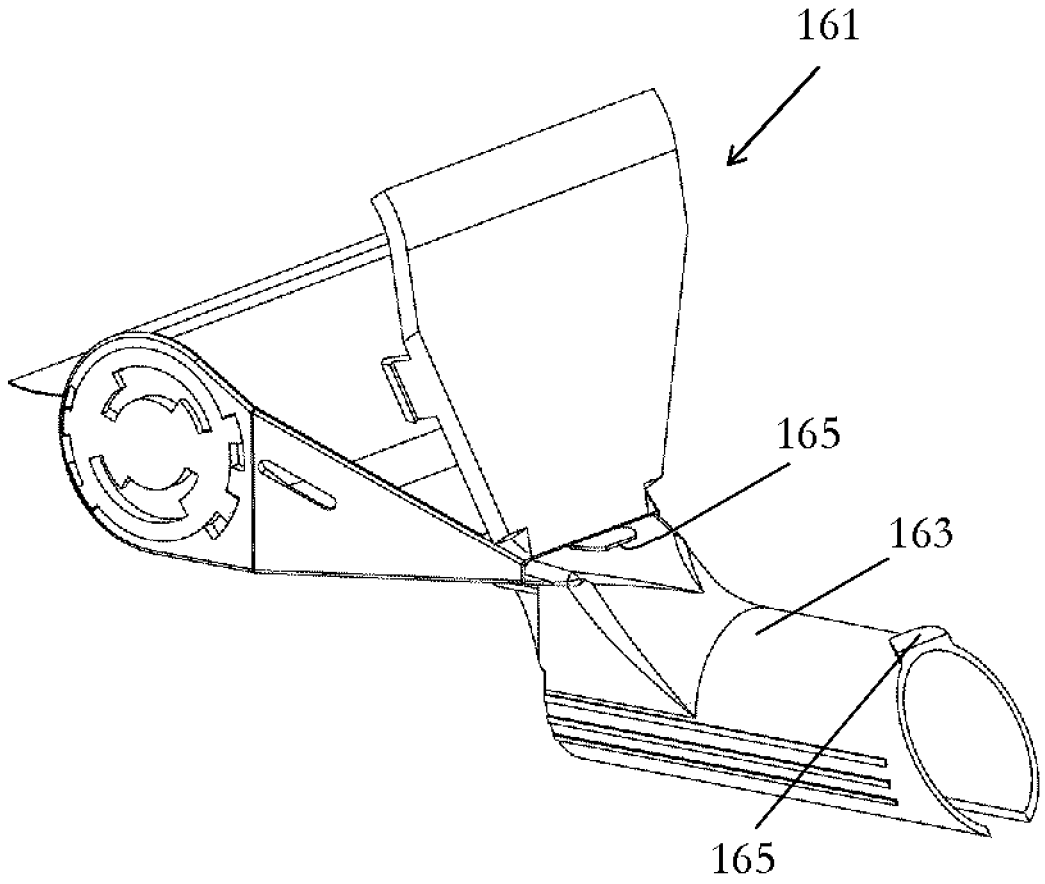
[Fig. 10]
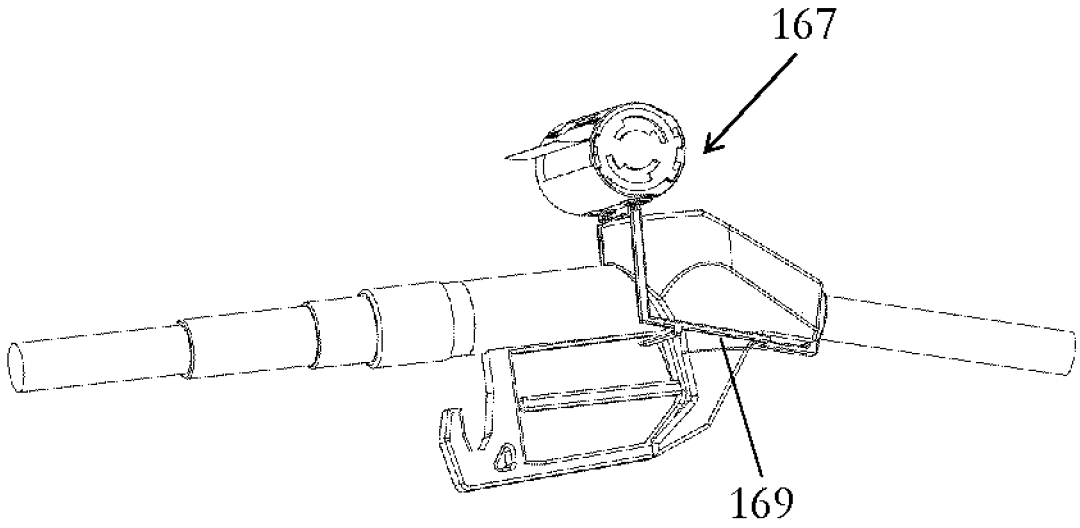

[Fig. 11]
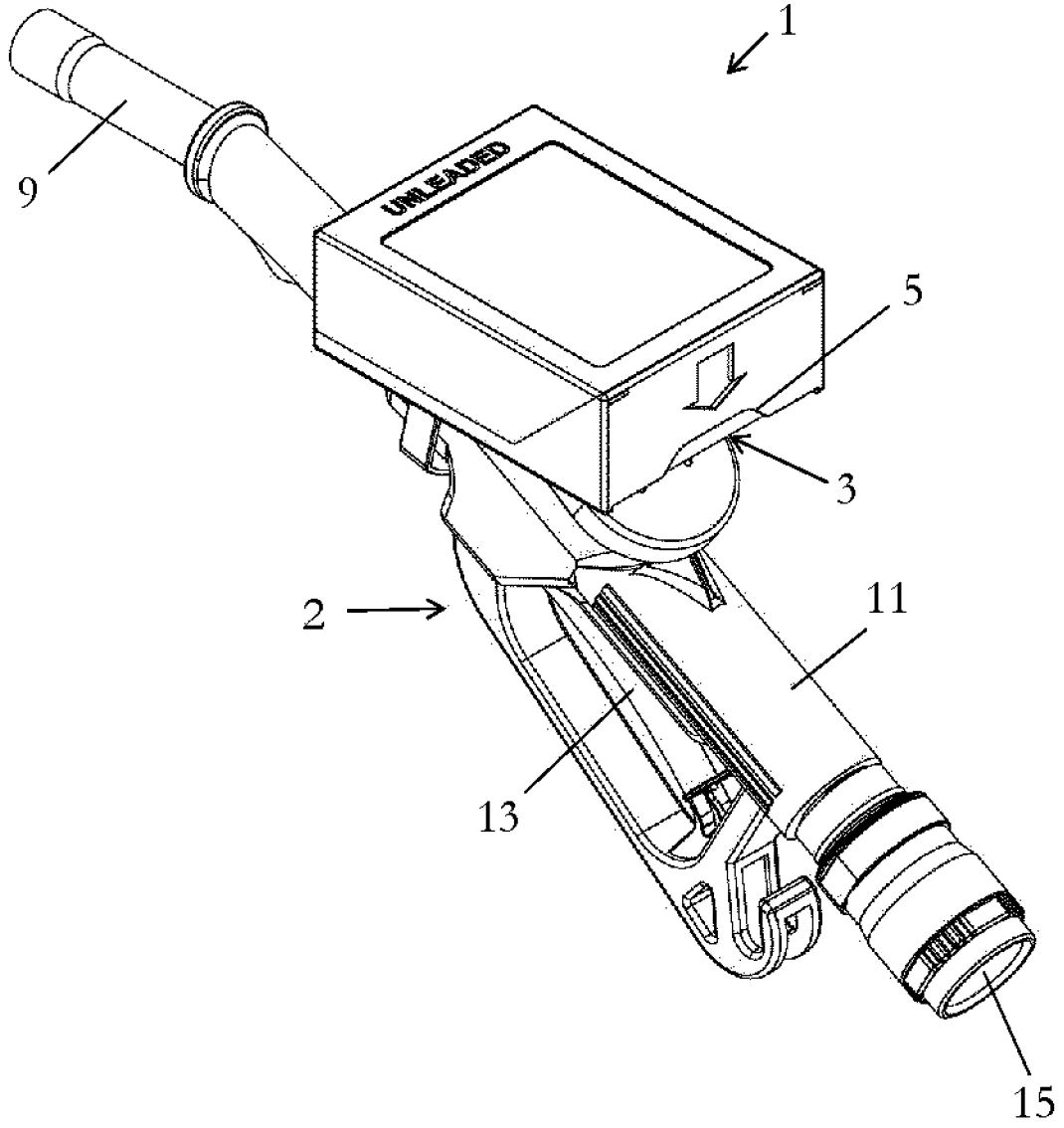

[Fig. 12]
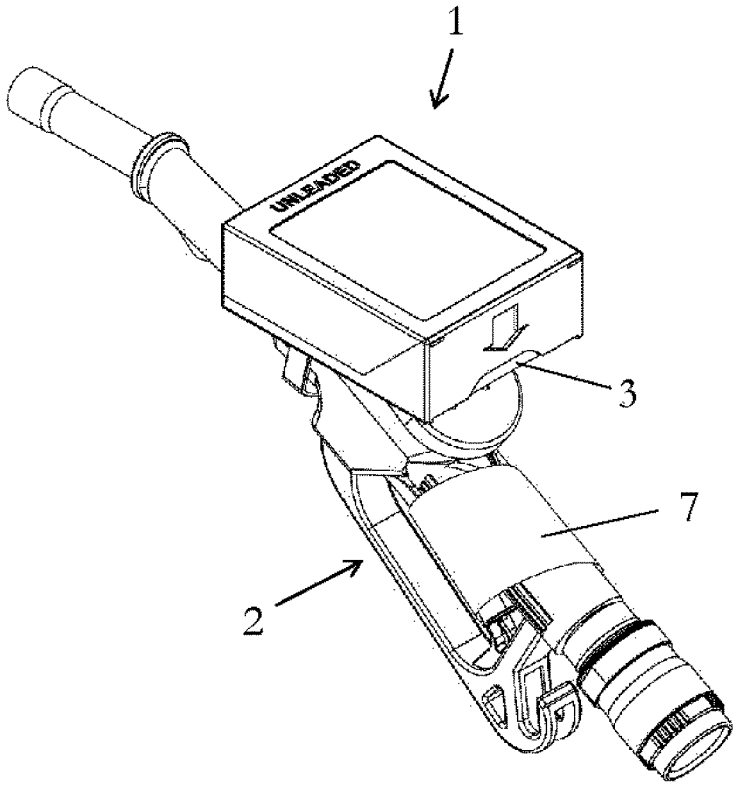
[Fig. 13]
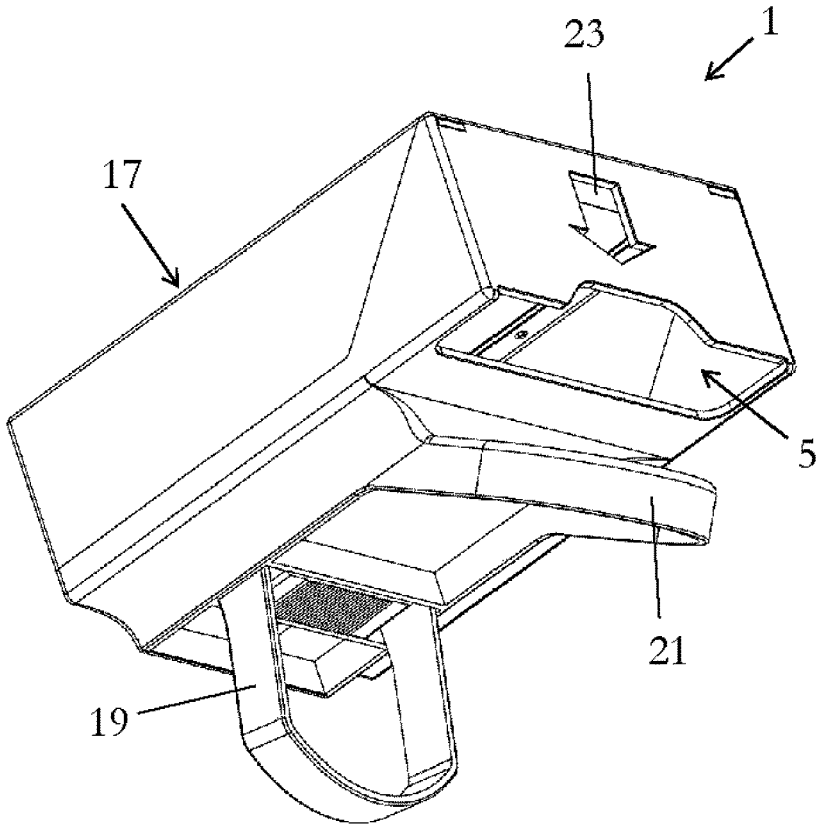

[Fig. 14]
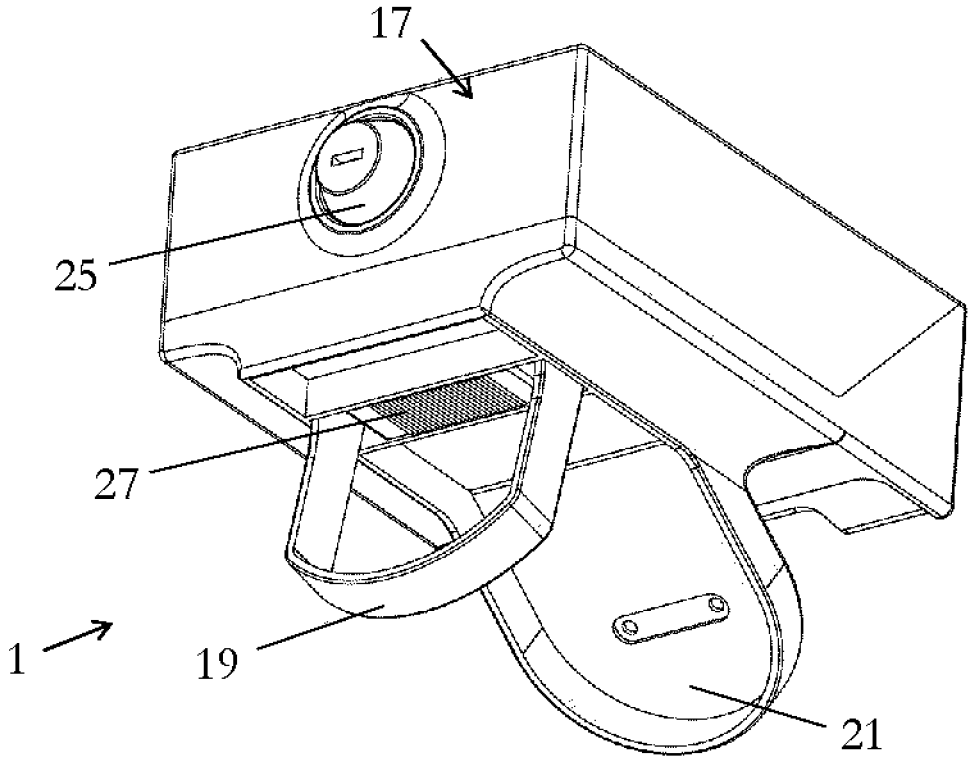
[Fig. 15a]
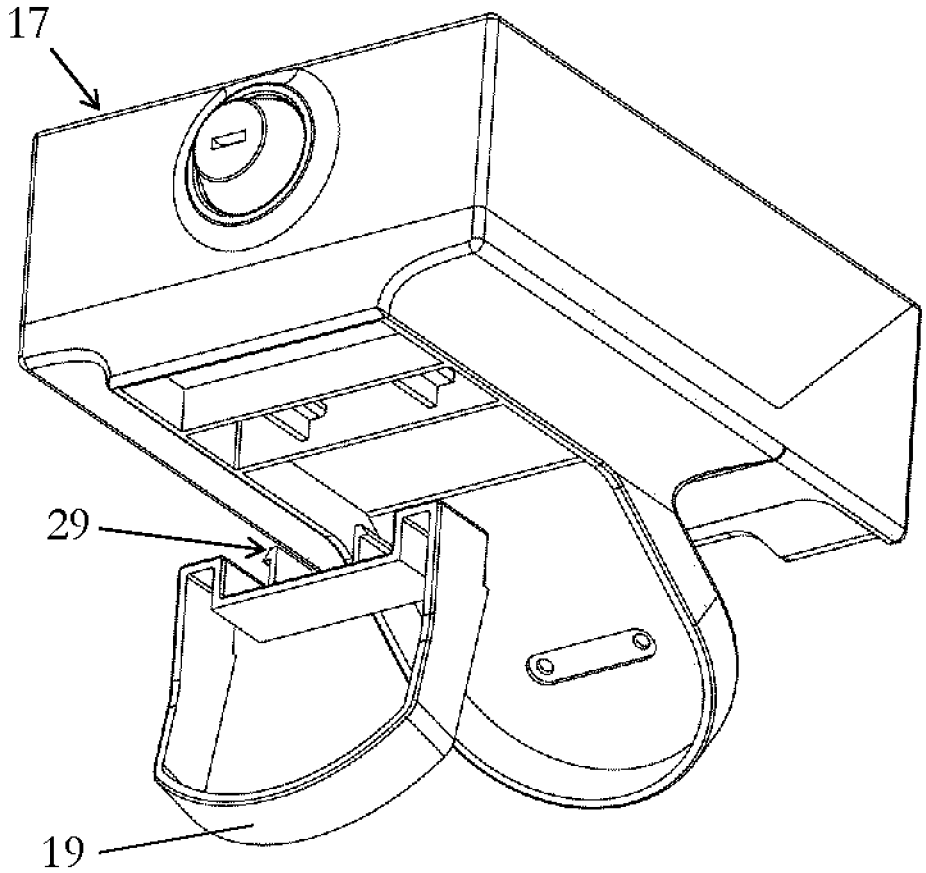

[Fig. 15b]
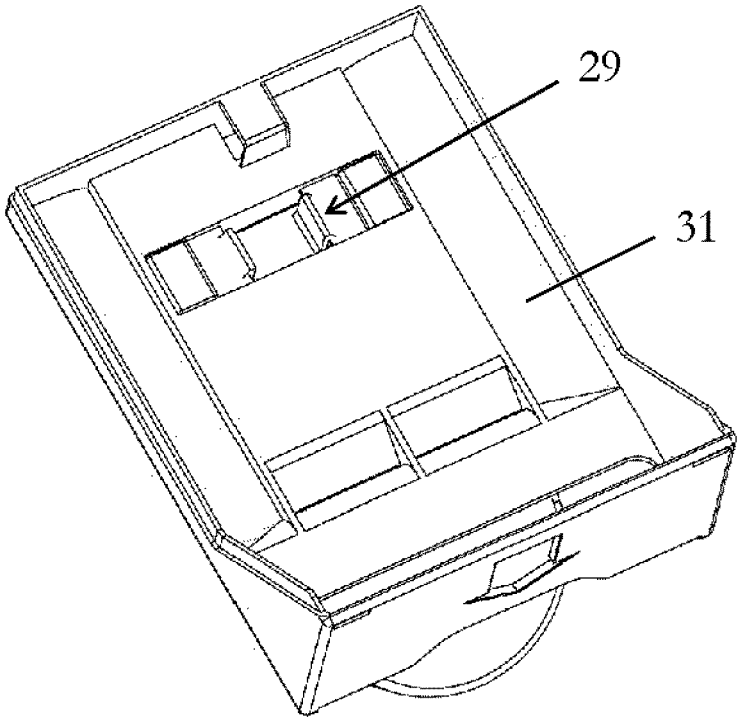
[Fig. 16a]
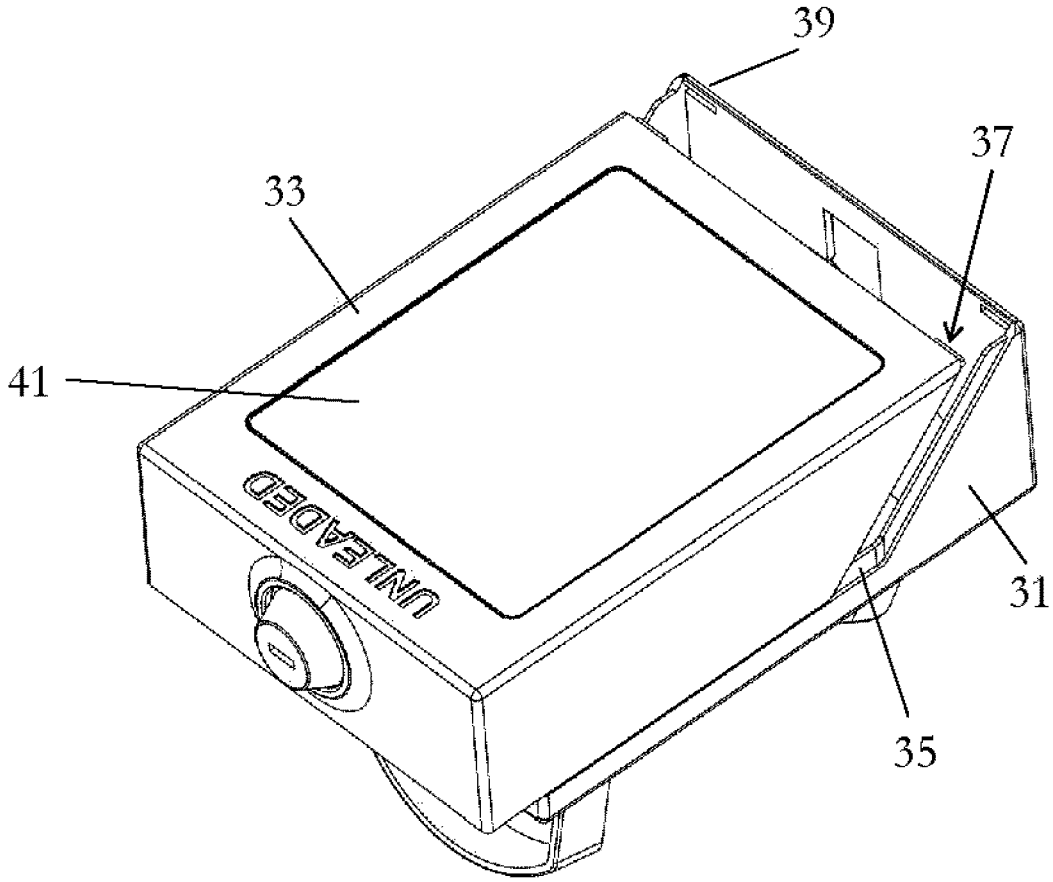

[Fig. 16b]
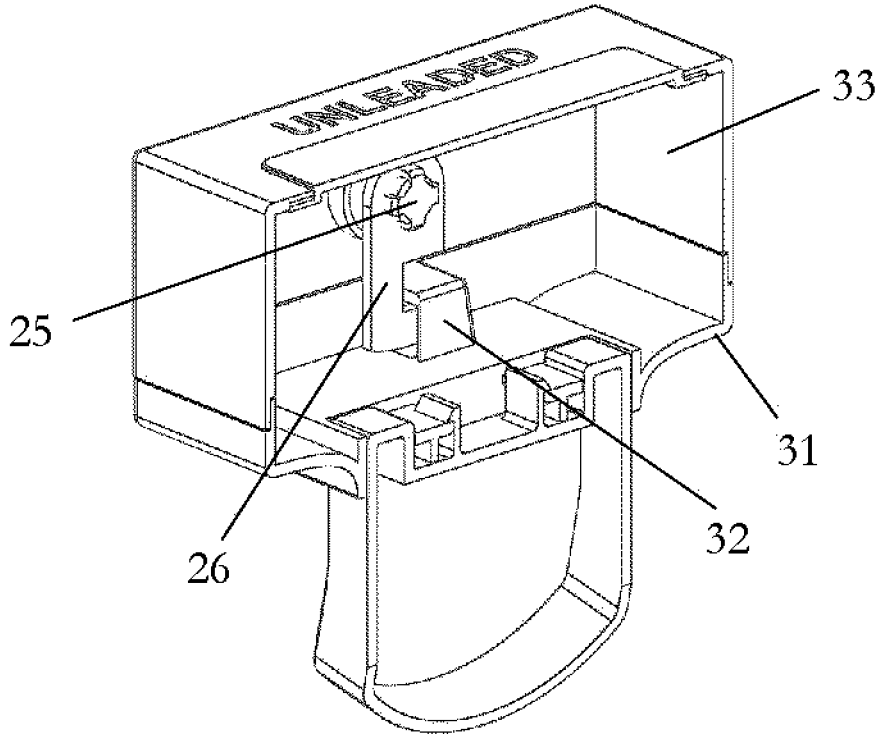
[Fig. 17a]
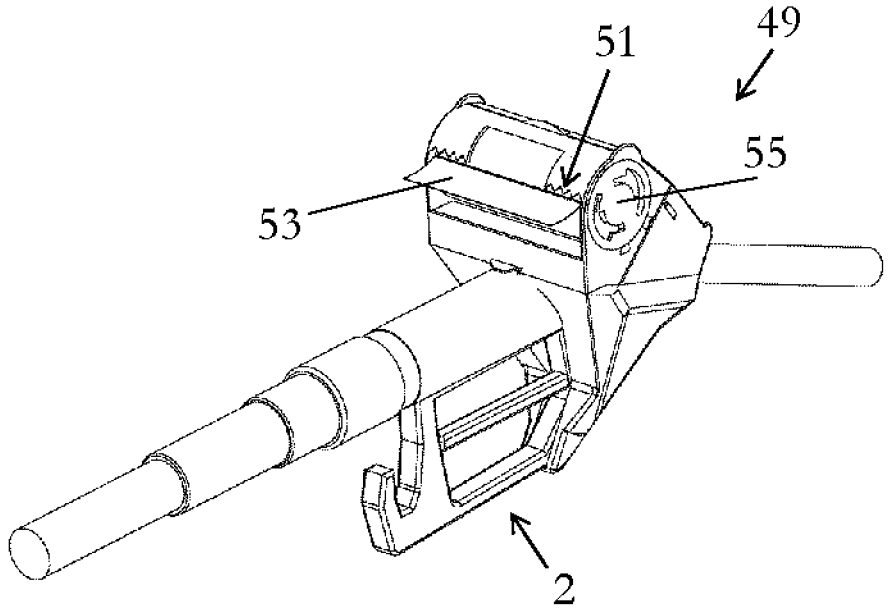

[Fig. 17b]
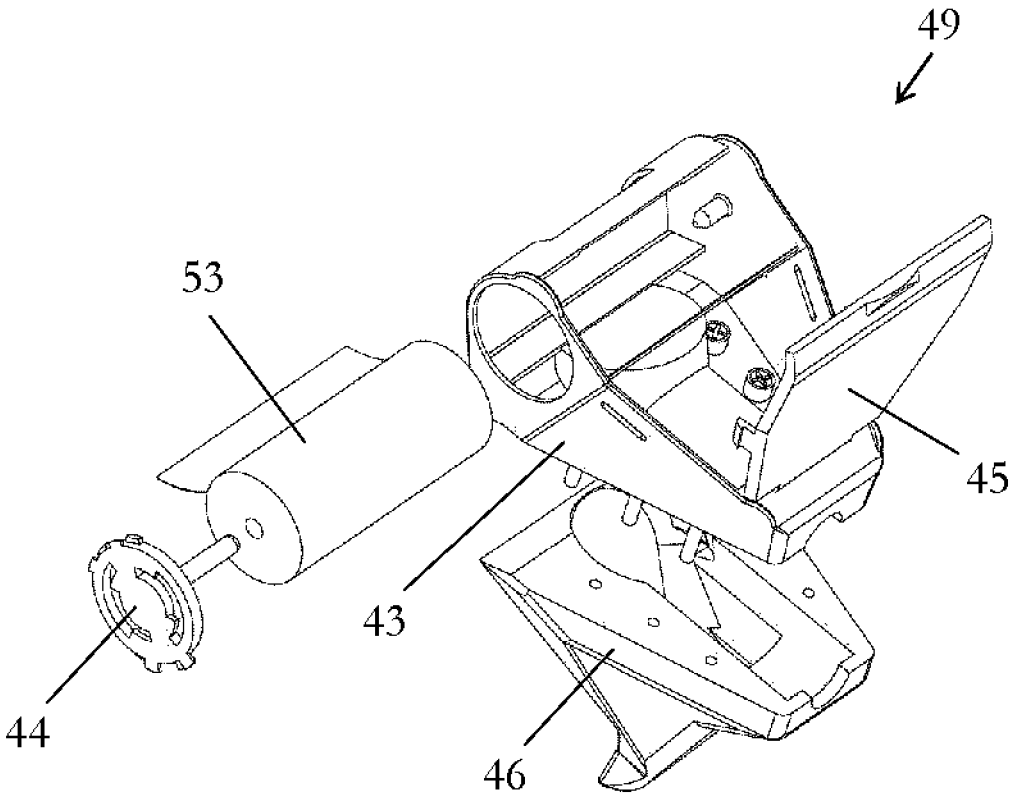
[Fig. 17c]
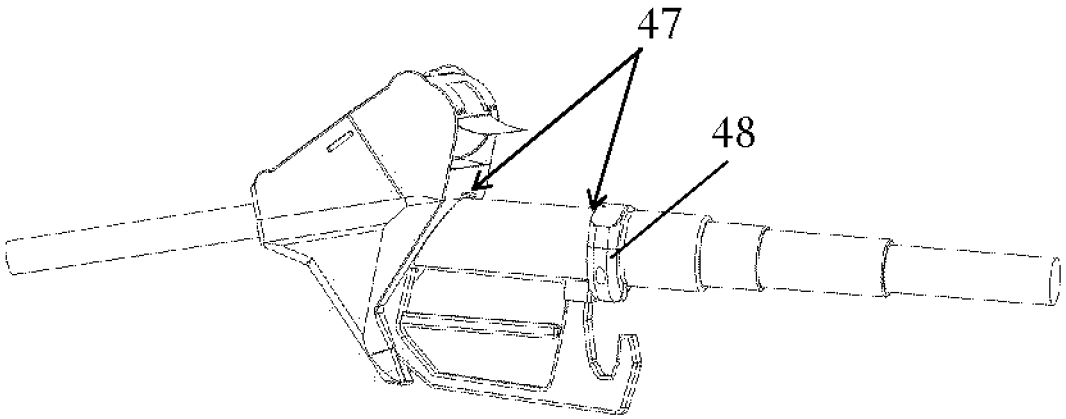

[Fig. 17d]
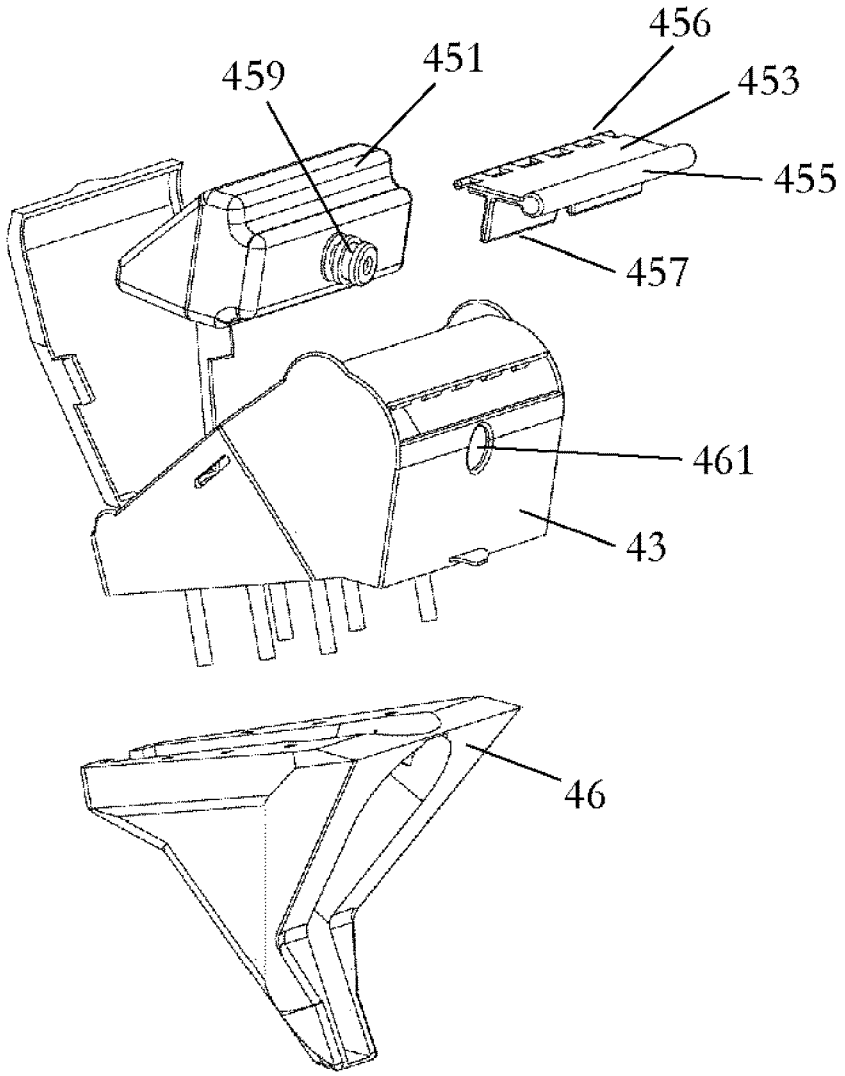
[Fig. 18a]
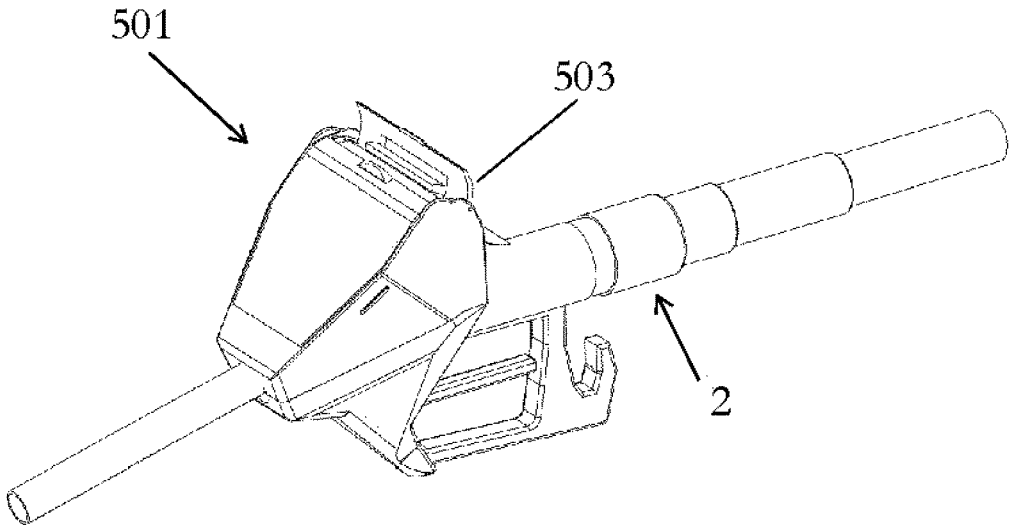

[Fig. 18b]
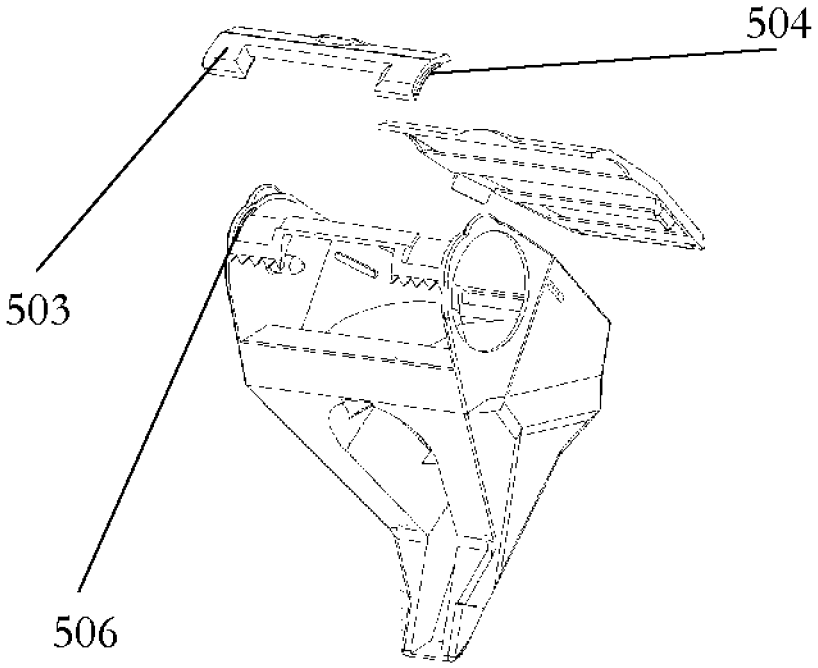

[Fig. 19]
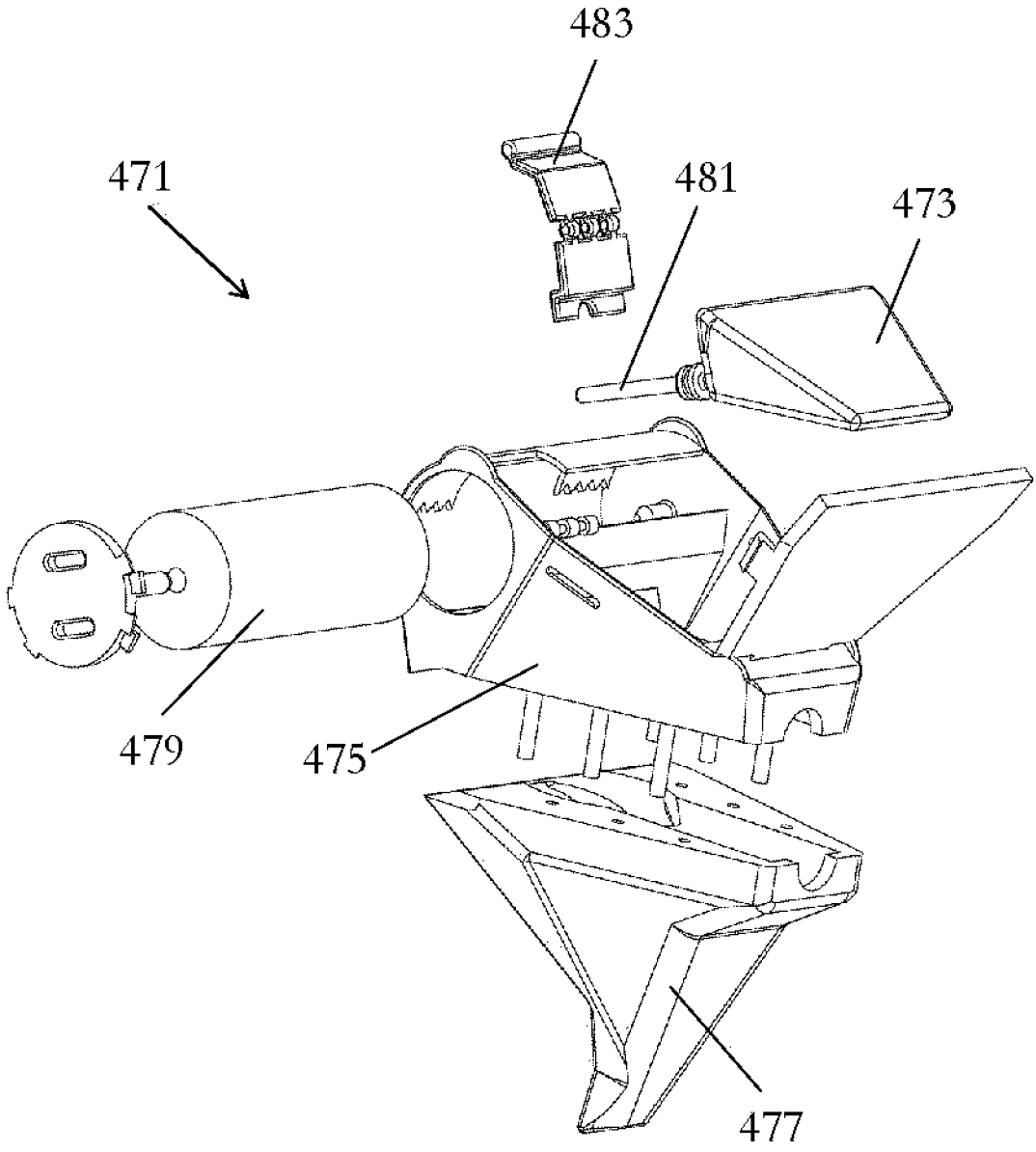

[Fig. 20]
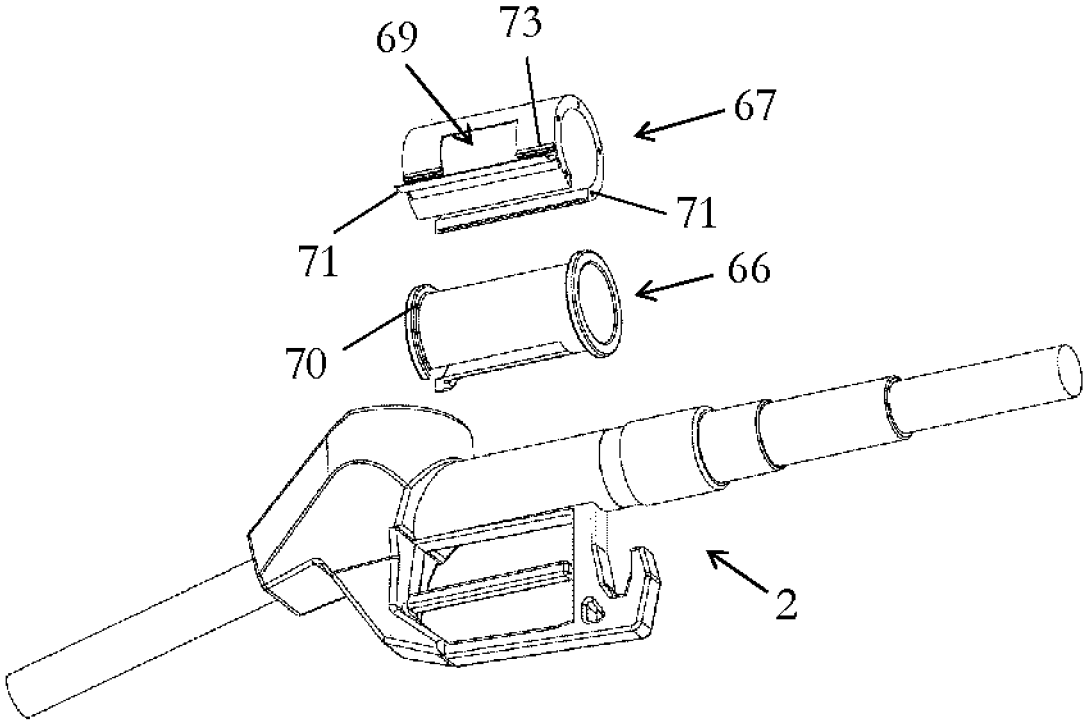
[Fig. 21]
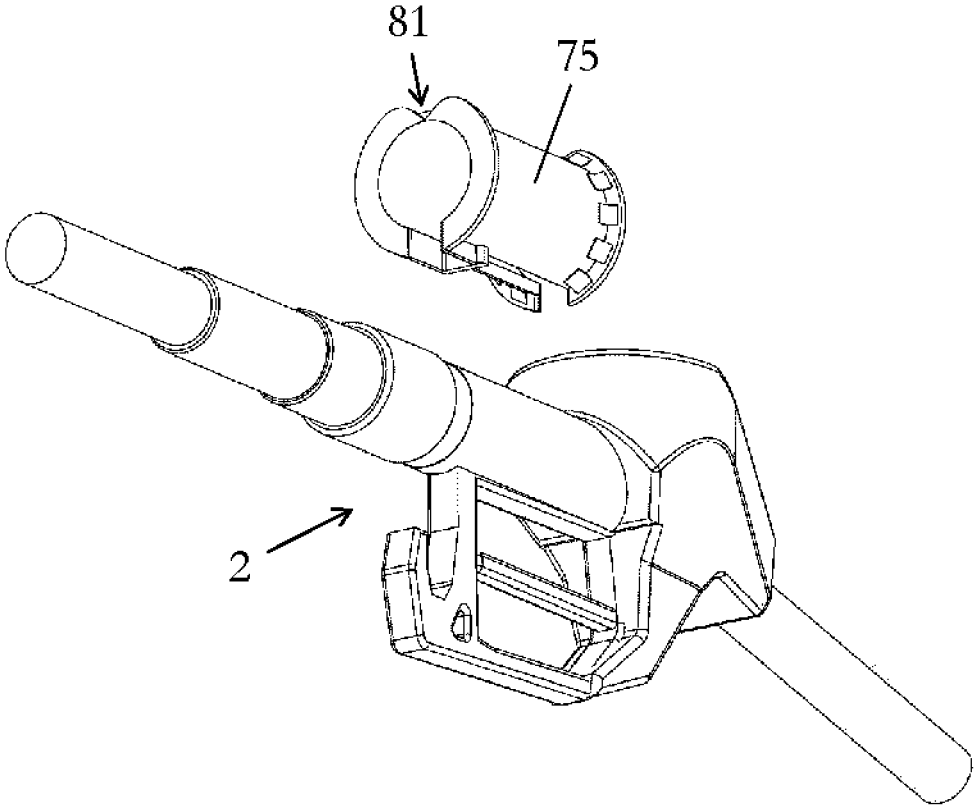

[Fig. 22]
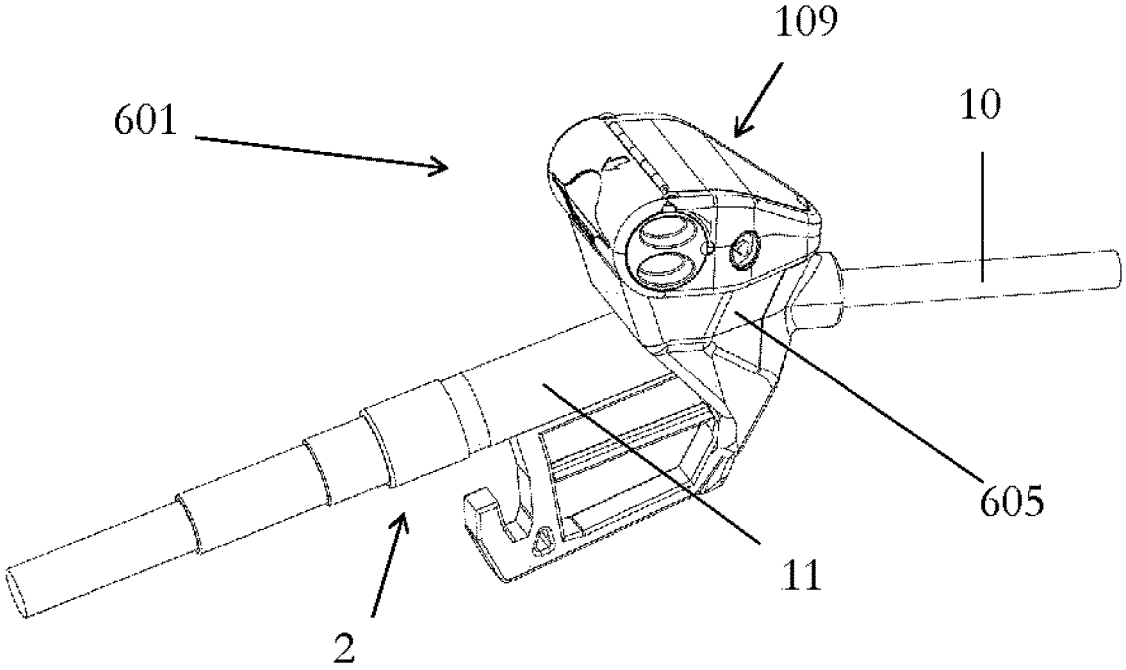
[Fig. 23]
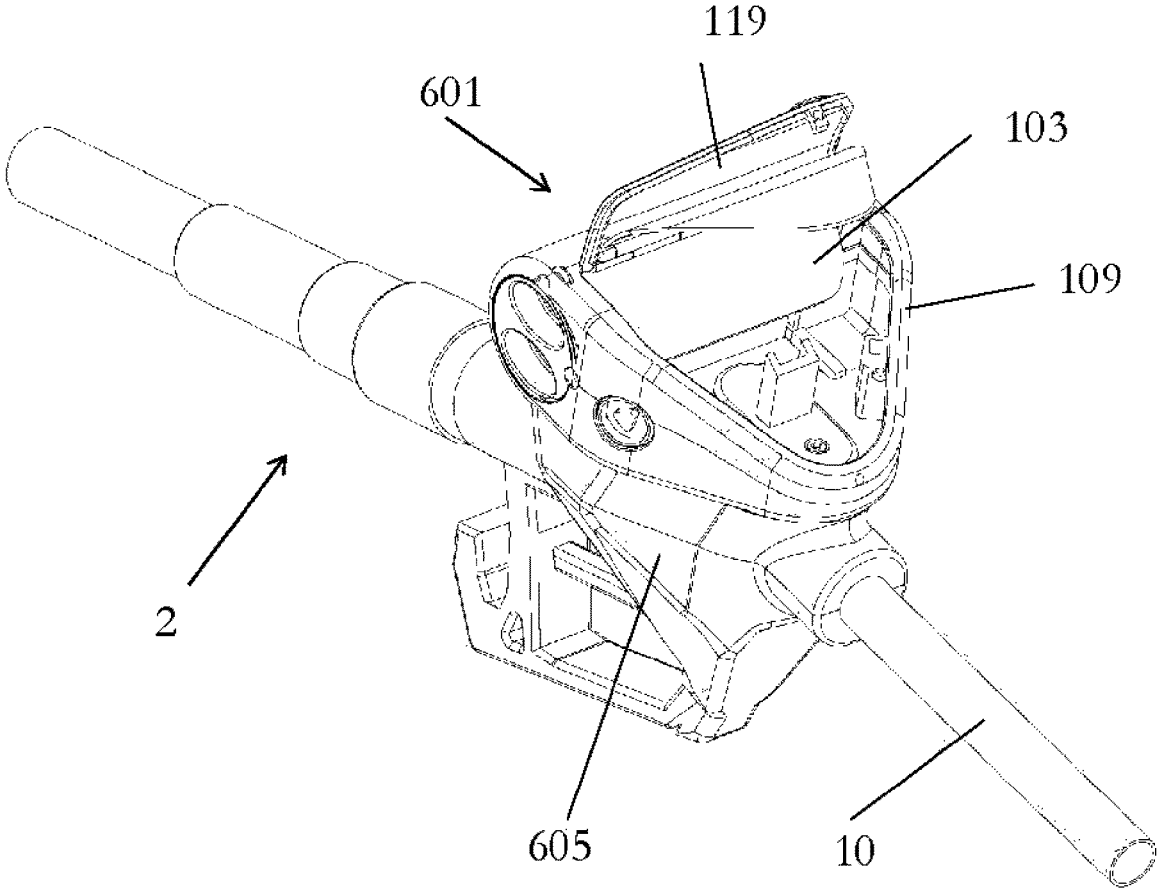

[Fig. 24]
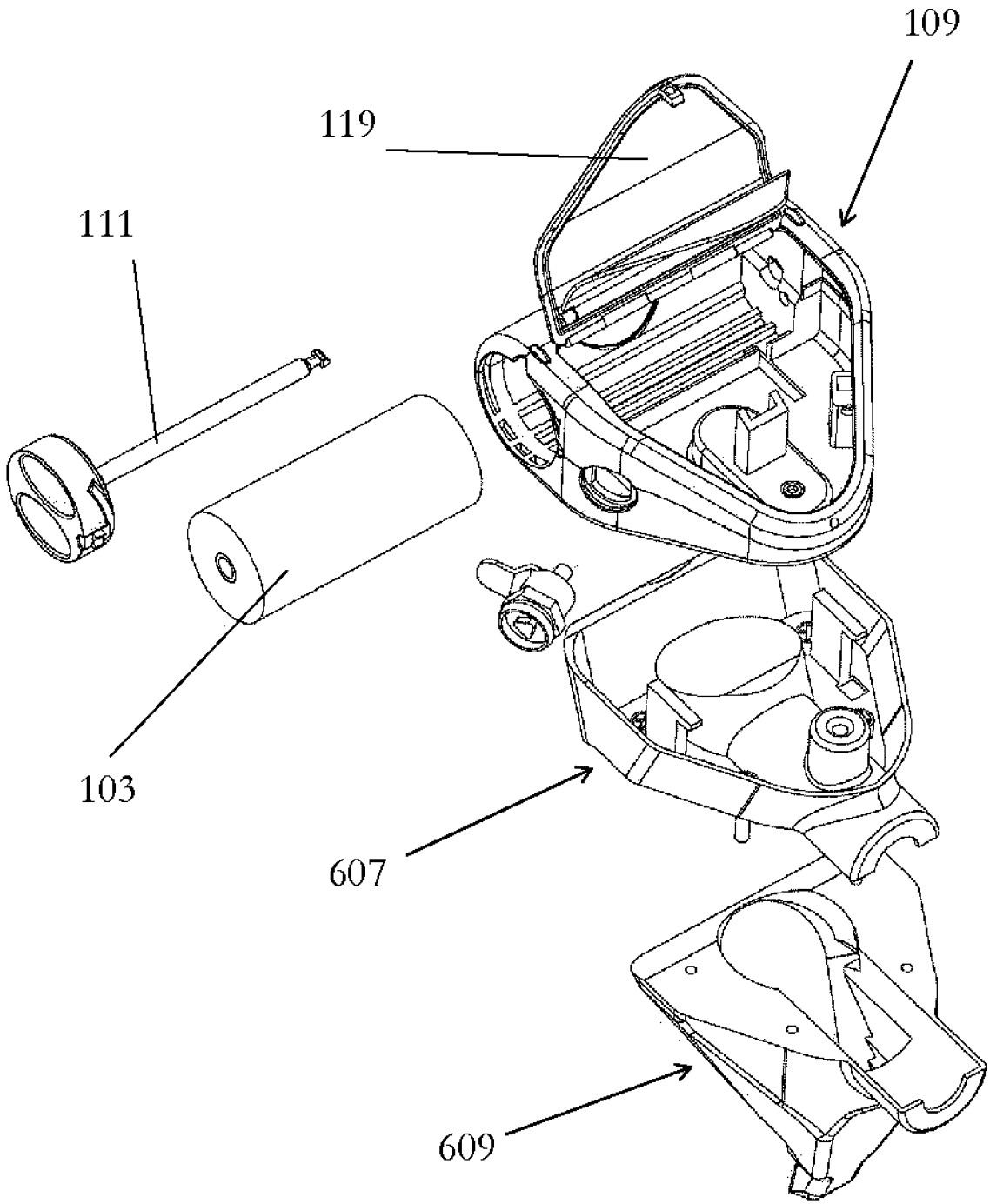

[Fig. 25]
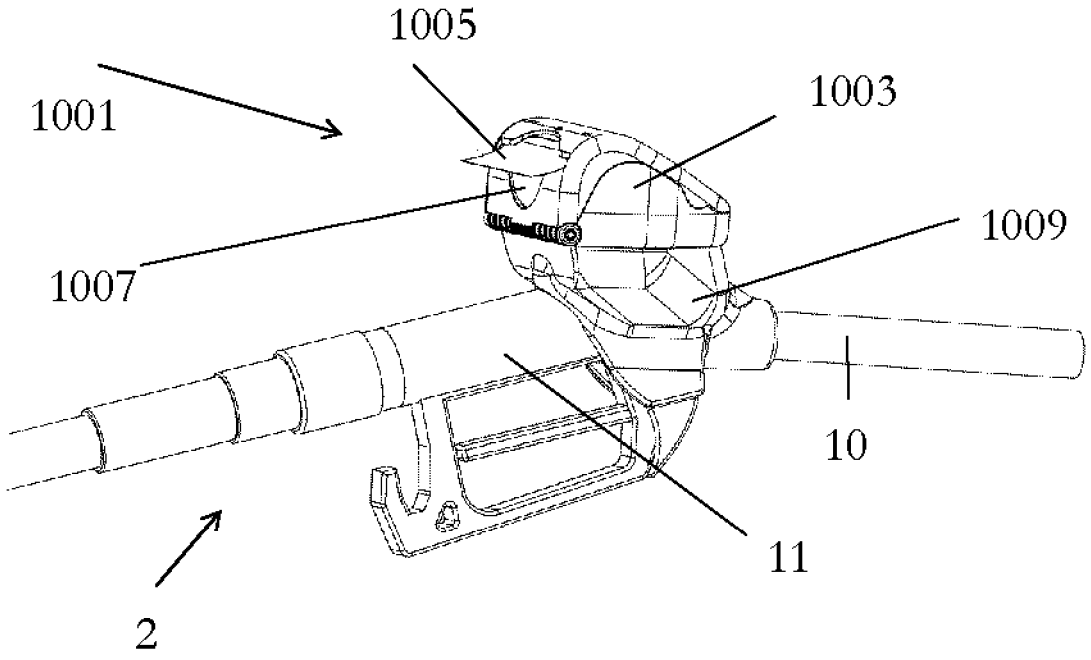
[Fig. 26]
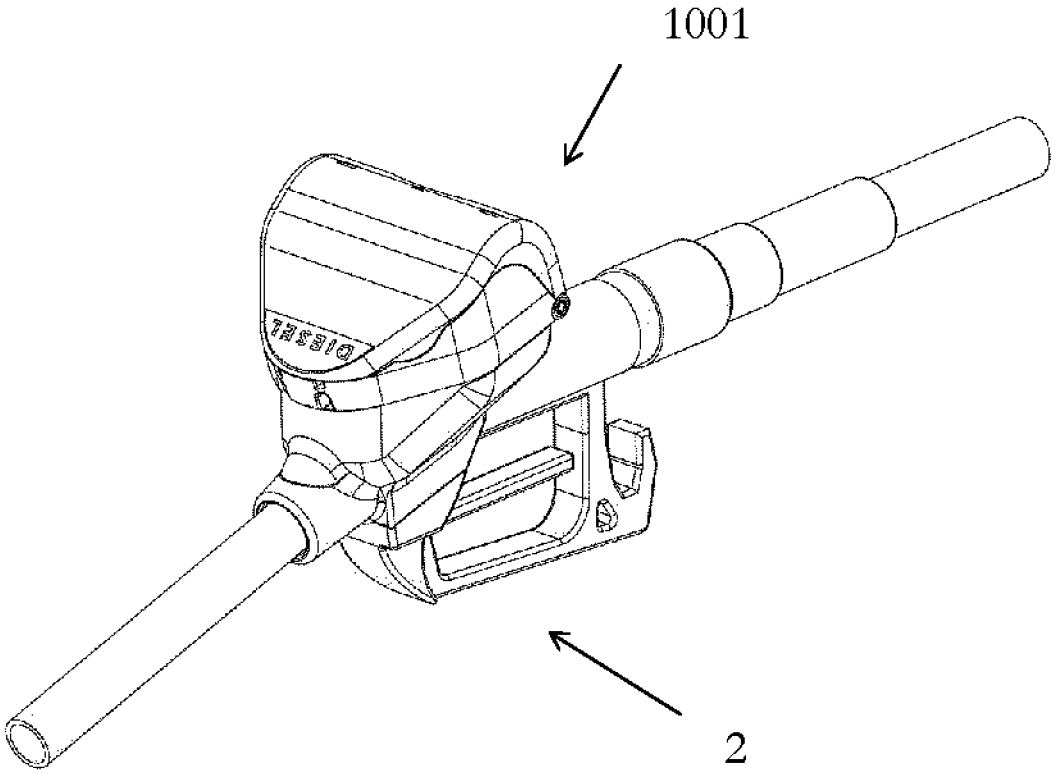

[Fig. 27]
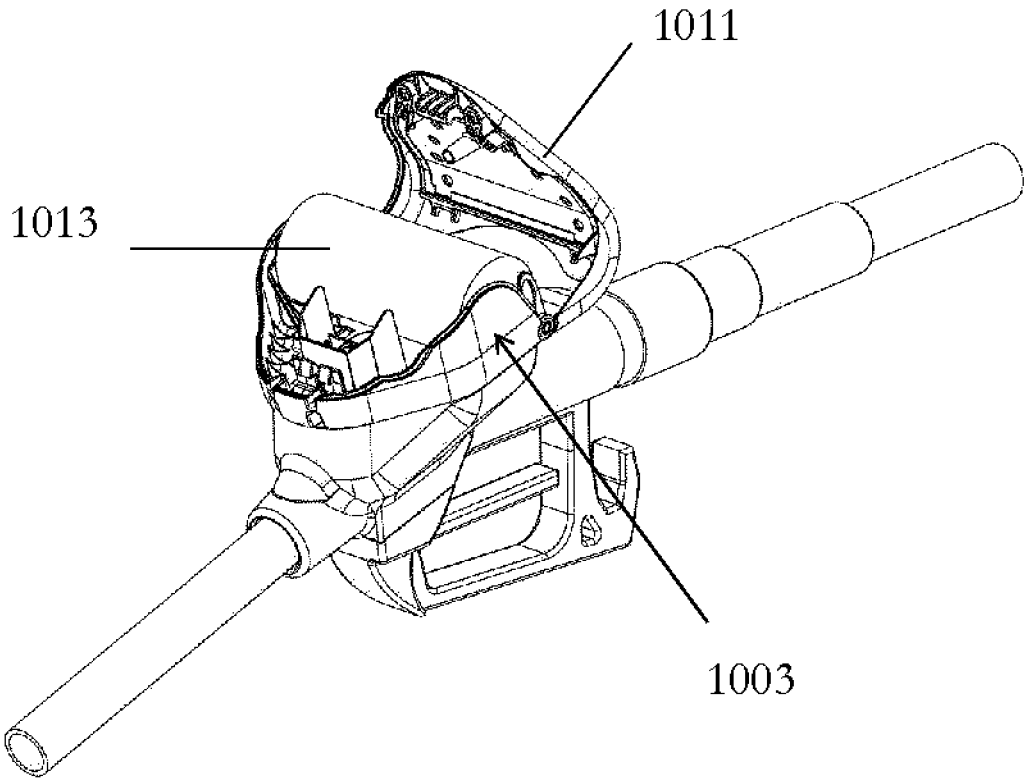

[Fig. 28]
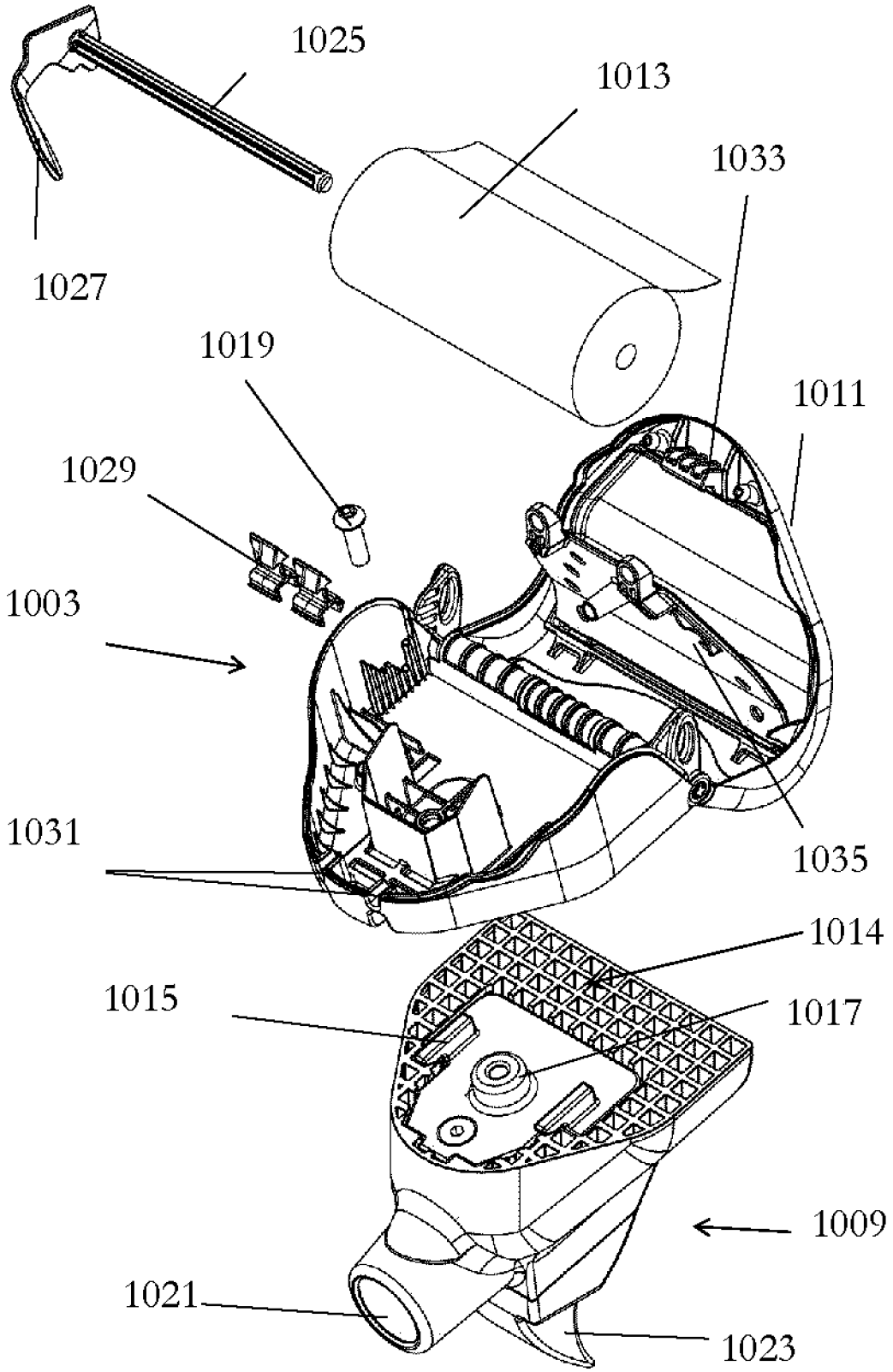

DISPENSER FOR PROVIDING HYGIENIC PROTECTION OF HANDS WHEN USING A FUEL PUMP

PRIORITY

The present application is related to, and claims the priority benefit of, and is a 35 U.S.C. 371 national stage application of, International Patent Application Serial No. PCT/IB2017/051830, filed Mar. 30, 2017, which is related to, and claims the priority benefit of, Great Britain Patent Application Serial No. 1605559.2, filed Apr. 1, 2016. The contents of each of the aforementioned patent applications are incorporated herein directly and by reference in their entirety.

TECHNICAL FIELD

Background

The present invention relates generally to a dispenser of protective barrier sheets and a method of protecting a user from contamination from a fuel pump, and finds particular, although not exclusive, utility in providing hygienic protection of hands when using a service station forecourt fuel pump.

When filling a vehicle with fuel, a person must touch and hold the dispenser nozzle by the handle, squeezing the trigger lever. This handle is contaminated by fuel vapour, residue, bacteria, dirt and contaminants by previous usage of multiple persons touching and holding the handle with contaminated hands. These contaminants build up and are transferred onto the hands of every person making contact with and holding the handle.

As well as being hazardous to health, these contaminants, especially fuel residue, can leave a persistent odour and 'greasy' feeling on the hands and can be very hard to remove through normal cleaning. In particular wiping the hands with a paper towel is insufficient to remove the odour and greasy feeling. It is not usually practical for a person to wash hands directly after using a fuel pump. This odour and residue is also then transferred into the vehicle interior, in particular to the door handles, steering wheel and gear knob, and can remain on the person or surface for a considerable time after use. For instance, in petrol stations located adjacent to supermarkets, a person may fuel a vehicle, contaminate their hands, and then make contact with a supermarket trolley handle, groceries and foodstuffs with fuel residue and bacterial contaminants on their hands.

It is known to provide protective gloves in service station forecourts; however, as fuelling a vehicle is often conducted in a queue, and in particular while being watched by the next customer, pressure may be felt by a user to finish fuelling as quickly and as efficiently as possible. Therefore, a user may be distracted by the feeling of pressure to hurry and make way for the next customer, thus inadvertently prevented from locating and putting on disposable protective gloves.

In addition, the location of such hand protection can vary widely between different fuel station forecourts, and so it is not always immediately evident to a user where they are positioned. There are many instances where their location is such that to retrieve one requires physically walking out of the user's own fuel filling area into an area where another customer is already present and potentially into another customer's personal space. This can create an awkward and uncomfortable feeling, which can add to further deter a user from seeking hand protection unless the location of such protection is made so immediately noticeable, available and direct to hand, that no additional effort is perceived by the user in using such protection and it is in essence a second-nature action.

The present invention overcomes this by offering hand protection directly on a fuel gun, where it is housed, positioned and retrieved in such a way that it is very easy for the user to notice, locate, retrieve and use said protection.

BRIEF SUMMARY

According to a first aspect of the present invention, there is provided a protective material dispenser for use with a fuel pump of the kind comprising: a hose for conveying fuel therein, the hose terminating at a nozzle for insertion into a vehicle's filling inlet; and a hand grip provided adjacent to the nozzle for manual positioning of the nozzle into the vehicle's filling inlet; the protective material dispenser comprising: a plurality of couplings, each coupling configured to be removably securable in a respective manner to a respective part of a fuel pump, and each provided with a housing attachment part; and a housing for receiving protective material therein, the housing comprising: an opening through which at least some of the protective material is removable; and an attachment mechanism configured to cooperatively engage with the housing attachment part of each of the plurality of couplings, such that the housing is removably securable to each of the plurality of couplings; such that the housing may be secured to a first part of a fuel pump via a first one of the plurality of couplings, removed therefrom and re-secured to a second part of the fuel pump via a second one of the plurality of couplings.

In this way, a user may easily retrieve protective material from the dispenser immediately prior to touching the fuel pump hand grip, or immediately after doing so. The user may then cover the hand grip, or cover their hands, to protect his/her hands from making direct contact therewith, or sanitise their hands after using the fuel pump.

The fuel pump may be for instance a fuel dispenser, bowser (in Australian English), petrol pump (in UK English), or gas pump (in North America English), typically located at a filling station that is used to pump gasoline, diesel, CNG, CGH2, HCNG, LPG, LH2, ethanol fuel, biofuels like biodiesel, kerosene, hydrogen, or other suitable types of fuel into vehicles, such as automobiles, boats, lorries, etc. The fuel pump may be an energy discharge outlet, such as an electric charging point, in which the hose may carry electrical cabling. The dispenser may be configured for use with apparatus other than a fuel dispenser, for instance, equipment used to retrieve, dispense and/or supply oil, gas and/or fuels in the oil, gas and fuel industry, and/or other handles and/or handling points where regularly used by multiple persons.

The hose may be substantially flexible, and may have a substantially circular axial cross-section.

The nozzle may be substantially rigid, and may have a substantially circular axial cross-section.

The hand grip may be substantially cylindrical, and may be arranged coaxially with the hose and/or the nozzle. In particular, the hand grip may surround and/or wrap-around the hose and/or nozzle. The fuel pump may comprise an activation trigger located adjacent to the hand grip, such that a user may activate flow of fuel within the hose, while maintaining the nozzle's position within the filling inlet of a vehicle.

Herein the term fuel gun may be used to refer to the combination of the hose, the nozzle, the hand grip and (optionally) the trigger.

The protective material may be protective barrier material, and the housing may comprise a plurality of pieces of protective barrier material therein.

The housing may contain, for example at least 50, 100, 150, 200, 300, or 500 pieces. The pieces may be sheets, towels, bags (e.g. single bags), gloves, sanitising sachets or similar articles.

The housing may have a length in a direction substantially parallel to an axis of the fuel gun when coupled thereto of between 10 cm and 30 cm, in particular between 12 cm and 25 cm, more particularly between 15 cm and 20 cm. The housing may have a width in a direction substantially at right angles to an axis of the fuel gun when coupled thereto of between 8 cm and 20 cm, in particular between 10 cm and 15 cm, more particularly between 11 cm and 14 cm. The housing may have a height in a direction substantially radially outward from the axis of the fuel gun when coupled thereto of between 5 cm and 15 cm, in particular between 7 cm and 13 cm, more particularly between 9 and 11 cm.

The opening may be configured to allow one, only one or at least one piece of protective barrier material to be removed therefrom. The opening may comprise a slot and/or a hole. The slot may be elongate; that is, having a length substantially greater than its width. This may have any cross-section, and may have a size sufficient for a user to pass a finger therethrough. In embodiments in which the opening comprises a slot and a hole, they may be contiguous such that a user may insert his/her finger through the hole to contact a piece of the protective barrier material, and may pull/slide the protective barrier material out of the slot.

The hole may be a circular hole, for instance approximately 15 mm in diameter, such that pieces/sheets may be pulled therethrough. The protective barrier material could be stored loose inside the housing, or within a cartridge, in the form of layers, rolls, or simply 'stuffed' irregularly. Adjacent pieces/sheets may be attached to one another by perforations so that pulling one brings forward the next, and the retrieval hole acts as a resistance to break the perforation and separate the piece. The circular retrieval hole could be partially elongated to form a finger slot to aid retrieval of a piece if the next one has not been brought forward.

The protective barrier material may comprise paper (e.g. paper towels), wax paper, polythene or any other suitable form of material for providing a protective barrier for a user's hands against fuel, dirt and/or bacteria. The protective barrier material may be folded; however, in some embodiments, the protective barrier material is unfolded. The pieces may be arranged within the housing and in a plurality of layers and/or as a continuous roll, for instance including perforations for separation of individual pieces therefrom. Each piece may be frangibly-attached to an adjacent piece. The pieces may be arranged such that removing one piece from the housing would offer up an adjacent piece to facilitate the next person retrieving a protective piece. Each piece may be provided with a tab thereon, for presentation to a user, such that the user can remove the piece from the housing.

The pieces of protective barrier material may be disposable or reusable, and may be sheets, towels, bags (e.g. single bags), gloves, sanitising sachets or similar articles.

The protective material may be sanitising fluid, for instance liquid, gel or foam, for providing an impermeable layer over the hands, or for sanitising the hands after use.

The housing could be configured to receive a cartridge of varied shape and size, that would in turn contain protective barrier material of varied shape and size. The cartridge could contain a hand sanitiser or cleanser in the form of a liquid gel or sachet of disposable cleansing material.

The housing could be configured to accommodate more than one cartridge so as to dispense a protective barrier, and also a sanitising/cleansing gel or material, or any other combination.

One method of containing the protective pieces is to have them contained in a pack, i.e. an open-ended card/plastic/paper/polythene casing/package/sleeve, a bit like a travel-pack of tissues. This is for ease of handling, storing, manufacturing, replacing. It also means that if the fuel gun is dropped to the floor and the dispenser housing breaks open, there is only a single pack of pieces that have come loose rather than hundreds of individual pieces blowing around in the wind.

The protective barrier material may be sized to wrap around an exterior of the hand grip, in particular it may be sized to wrap around an exterior of the hand grip and the activation trigger. The protective barrier material may have a lateral extent of between 15 cm and 30 cm, in particular between 20 cm and 25 cm, for instance approximately 20 cm or 25 cm. The lateral extent may be an unfolded extent.

The first one of the plurality of couplings may comprise: at least one coupling member configured to entirely encircle and wrap around at least one of the hose, nozzle and hand grip, to prevent movement of the housing away from said at least one of the hose, nozzle and hand grip in a direction substantially at right angles to an axis of the hose, the nozzle and/or the hand grip; and at least one locating member configured to prevent movement of the housing parallel to the axis.

The at least one coupling member may be releasably attached to the housing.

In this regard, the hose and/or nozzle may not be straight, and therefore the direction of flow of fuel within the fuel gun is to be considered to be the tangential flow substantially within the region about which the coupling member is passed.

The at least one locating member may be configured to (entirely and/or at least partially) encircle a portion of the fuel gun.

In this regard, the fuel gun may not be straight, and therefore the axis (i.e. of the fuel gun) may be viewed as the direction of flow of fuel within the fuel gun substantially within the region substantially adjacent to the locating member and/or about which the coupling member is passed.

The locating member may be separate and/or distinct from the coupling member.

The coupling may be configured to remain releasably connected to a fuel pump/gun even when the housing unit is disconnected from the coupling, such as two separate halves, releasably connected by hooking mechanisms, clips, protrusions, slots and/or fasteners such as nuts and bolts. For instance, the coupling may utilise existing fastener connections found on a typical fuel gun to affix to, providing additional securing arrangements and preventing the dispenser from moving away from the fuel gun body. In order to provide additional stability to the dispenser to prevent movement away from the fuel gun body, the coupling may also be configured to wrap around and/or releasably connect to at least one portion of the fuel gun body, for instance, the fuel gun nozzle outlet, the trigger hinge/support frame, the protrusion between the hand-grip and the nozzle outlet (e.g. such as the nozzle body), the hose connector, the hand-grip, the trigger lever.

The coupling, housing, cartridge and/or the protective barrier material may provide an indication of the fuel type associated with the fuel gun, for instance a word or colour to match conventional colour coding of fuel types (e.g. green, black, blue and yellow). The coupling, housing, cartridge and/or protective barrier material may provide a region for advertising, slogans, logos and/or instructional messages to be displayed.

The dispenser may comprise plastics material, open- or closed-cell foams and/or metal.

The cartridge casing could be of a material such as card, paper, plastics material, polythene. It may be of a rigid or flexible form. It could also utilise fasteners of plastics material and/or metals. The cartridge casing may also provide suitable space for instructional messages and/or advertising, for instance, a lightweight card packaging would keep its structure while the piece contents are diminishing, thus a printed message on the outer top surface of the card packaging would remain in full sight against the viewing window.

One of the plurality of couplings may comprise a sheath to surround a grip of a fuel gun to which it may be applied. The sheath may comprise a silver-impregnated plastics material to offer natural anti-bacterial properties.

One of the plurality of couplings may comprise an attachment part integrally formed with a fuel gun or fuel pump.

One of the plurality of couplings may comprise an adhesive pad and/or (e.g. planar) bracket that may be either stuck or affixed with fasteners to a wall; onto which the dispenser is releasably securable.

The dispenser may comprise a conductive coating, such as conductive paint, the dispenser may comprise a conductive material, and/or the dispenser may comprise an earthing strip configured to connect to a electrical ground/earth (e.g. a nozzle). In this way, a build-up of electrostatic charge may be prevented.

The dispenser and coupling arrangements could be configured so as to be suitable for dispensing protective barrier material from other high-traffic touch points such as trolleys, door handles, waste-bin handles, ATMs, point-of-sale payment card machines, escalators, dog-waste bins, walking sticks or other high-traffic areas where people regularly hold, grip or touch surfaces; or areas where hygiene is of importance, such as food preparation and medical facilities.

According to a second aspect of the present invention, there is provided a method of protecting a user from contamination due to a fuel pump, the method comprising: providing a fuel pump of the kind comprising: a hose for conveying fuel therein, the hose terminating at a nozzle; and a hand grip provided adjacent to the nozzle for manual positioning of the nozzle; providing a protective material dispenser according to the first aspect; releasably securing a first one of the plurality of couplings to a respective part of the fuel pump; releasably securing the housing to the first one of the plurality of couplings; providing the protective material within the housing of the protective material dispenser; removing some of the protective material from the housing through the opening.

According to a third aspect of the present invention, there is provided a protective material dispenser for use with a fuel pump of the kind comprising: a hose for conveying fuel therein, the hose terminating at a nozzle for insertion into a vehicle's filling inlet; and a hand grip provided adjacent to the nozzle for manual positioning of the nozzle into the vehicle's filling inlet; the protective material dispenser comprising: a housing for receiving protective material therein, the housing comprising: an opening through which at least some of the protective material is removable; at least one coupling member attached to the housing and configured to releasably secure the housing to the fuel pump by entirely encircling and wrapping around at least one of the hose, nozzle and hand grip, to prevent movement of the housing away from said at least one of the hose, nozzle and hand grip/fuel gun in a direction substantially at right angles to an axis of the hose, the nozzle and/or the hand grip; and at least one locating member configured to prevent movement of the housing parallel to the axis.

According to a fourth aspect of the present invention, there is provided a method for protecting a user from contamination due to a fuel pump, the method comprising: providing a fuel pump of the kind comprising: a hose for conveying fuel therein, the hose terminating at a nozzle; and a hand grip provided adjacent to the nozzle for manual positioning of the nozzle; providing a protective material dispenser according to the third aspect; releasably secure the housing of the protective barrier dispenser to the fuel pump, by wrapping the coupling member entirely around at least one of the hose, nozzle and hand grip; providing protective material within the housing of the protective material dispenser; removing at least some of the protective material from the housing through the opening.

BRIEF DESCRIPTION OF THE DRAWINGS

The above and other characteristics, features and advantages of the present invention will become apparent from the following detailed description, taken in conjunction with the accompanying drawings, which illustrate, by way of example, the principles of the invention. This description is given for the sake of example only, without limiting the scope of the invention. The reference figures quoted below refer to the attached drawings.

FIG. 1*a* is an exploded view of a first dispenser.

FIG. 1*b* is a perspective view of the dispenser of FIG. 1*a*.

FIG. 1*c* shows the key arrangement for use with the dispensers of FIG. 1*a*.

FIG. 1*d* is a perspective view of a modified version of the first dispenser in use on a fuel gun.

FIG. 1*e* is an exploded view of the dispenser of FIG. 1*d*.

FIG. 2*a* shows a first alternative coupling for the dispenser of FIG. 1*a*.

FIG. 2*b* shows a second alternative coupling for the dispenser of FIG. 1*a*.

FIG. 3 is an exploded view of a second dispenser in use on a fuel gun.

FIG. 4 is a perspective view of the second dispenser.

FIG. 5 shows the key arrangement for use with the dispensers of FIGS. 3 and 4.

FIG. 6 shows an alternative key arrangement to that shown in FIG. 5.

FIG. 7 is a perspective view of the second dispenser in use on a fuel gun.

FIG. 8 is an exploded view of a third dispenser.

FIG. 9 is a perspective view of a fourth dispenser.

FIG. 10 is a perspective view of a fifth dispenser.

FIG. 11 is a perspective view of a sixth dispenser in use on a fuel gun.

FIG. 12 is a perspective view of the dispenser shown in FIG. 11, with a sheet removed for use on the hand grip.

FIG. 13 is a perspective view of the dispenser shown in FIG. 11, detached from the fuel gun and with no sheets contained within the housing.

FIG. 14 is a further perspective view of the dispenser shown in FIG. 11, detached from the fuel gun.

FIGS. 15*a* and 15*b* show detail of the detachable coupling member of the dispenser shown in FIG. 11.

FIGS. 16*a* and 16*b* illustrates the opening and locking mechanism of the housing of the dispenser shown in FIG. 11.

FIG. 17*a* is a perspective view of a seventh dispenser in use on a fuel gun.

FIG. 17*b* is an exploded view of the dispenser of FIG. 17*a*.

FIG. 17*c* shows the dispenser of FIG. 17*a* in use on a fuel gun together with an optional extra part.

FIG. 17*d* is an exploded view of an eighth dispenser.

FIG. 18*a* is a perspective view of a ninth dispenser.

FIG. 18*b* is an exploded view of two component parts of the dispenser of FIG. 18*a*.

FIG. 19 is an exploded view of a tenth dispenser.

FIG. 20 is an exploded view of an eleventh dispenser for attachment to the hand grip of a fuel gun.

FIG. 21 is an exploded view of an alternative dispenser for attachment to the hand grip of a fuel gun.

FIG. 22 is a perspective view of a twelfth dispenser in use on a fuel gun.

FIG. 23 is an alternative perspective view the dispenser in FIG. 22 in use on a fuel gun.

FIG. 24 is an exploded view of the dispenser of FIGS. 22 and 23.

FIG. 25 is a perspective view of a thirteenth dispenser in use on a fuel gun.

FIG. 26 is an alternative perspective view the dispenser in FIG. 25 in use on a fuel gun.

FIG. 27 is a perspective view the dispenser in FIG. 26 shown in the open configuration.

FIG. 28 is an exploded view of the dispenser of FIG. 27.

DETAILED DESCRIPTION

The present invention will be described with respect to certain drawings but the invention is not limited thereto but only by the claims. The drawings described are only schematic and are non-limiting. Each drawing may not include all of the features of the invention and therefore should not necessarily be considered to be an embodiment of the invention. In the drawings, the size of some of the elements may be exaggerated and not drawn to scale for illustrative purposes. The dimensions and the relative dimensions do not correspond to actual reductions to practice of the invention.

Furthermore, the terms first, second, third and the like in the description and in the claims, are used for distinguishing between similar elements and not necessarily for describing a sequence, either temporally, spatially, in ranking or in any other manner. It is to be understood that the terms so used are interchangeable under appropriate circumstances and that operation is capable in other sequences than described or illustrated herein.

Moreover, the terms top, bottom, over, under and the like in the description and the claims are used for descriptive purposes and not necessarily for describing relative positions. It is to be understood that the terms so used are interchangeable under appropriate circumstances and that operation is capable in other orientations than described or illustrated herein.

It is to be noticed that the term "comprising", used in the claims, should not be interpreted as being restricted to the means listed thereafter; it does not exclude other elements or steps. It is thus to be interpreted as specifying the presence of the stated features, integers, steps or components as referred to, but does not preclude the presence or addition of one or more other features, integers, steps or components, or groups thereof. Thus, the scope of the expression "a device comprising means A and B" should not be limited to devices consisting only of components A and B. It means that with respect to the present invention, the only relevant components of the device are A and B.

Reference throughout this specification to "an embodiment" or "an aspect" means that a particular feature, structure or characteristic described in connection with the embodiment or aspect is included in at least one embodiment or aspect of the present invention. Thus, appearances of the phrases "in one embodiment", "in an embodiment", or "in an aspect" in various places throughout this specification are not necessarily all referring to the same embodiment or aspect, but may refer to different embodiments or aspects. Furthermore, the particular features, structures or characteristics of any embodiment or aspect of the invention may be combined in any suitable manner, as would be apparent to one of ordinary skill in the art from this disclosure, in one or more embodiments or aspects.

Similarly, it should be appreciated that in the description various features of the invention are sometimes grouped together in a single embodiment, figure, or description thereof for the purpose of streamlining the disclosure and aiding in the understanding of one or more of the various inventive aspects. This method of disclosure, however, is not to be interpreted as reflecting an intention that the claimed invention requires more features than are expressly recited in each claim. Moreover, the description of any individual drawing or aspect should not necessarily be considered to be an embodiment of the invention. Rather, as the following claims reflect, inventive aspects lie in fewer than all features of a single foregoing disclosed embodiment. Thus, the claims following the detailed description are hereby expressly incorporated into this detailed description, with each claim standing on its own as a separate embodiment of this invention.

Furthermore, while some embodiments described herein include some features included in other embodiments, combinations of features of different embodiments are meant to be within the scope of the invention, and form yet further embodiments, as will be understood by those skilled in the art. For example, in the following claims, any of the claimed embodiments can be used in any combination.

In the description provided herein, numerous specific details are set forth. However, it is understood that embodiments of the invention may be practised without these specific details. In other instances, well-known methods, structures and techniques have not been shown in detail in order not to obscure an understanding of this description.

In the discussion of the invention, unless stated to the contrary, the disclosure of alternative values for the upper or lower limit of the permitted range of a parameter, coupled with an indication that one of said values is more highly preferred than the other, is to be construed as an implied statement that each intermediate value of said parameter, lying between the more preferred and the less preferred of said alternatives, is itself preferred to said less preferred value and also to each value lying between said less preferred value and said intermediate value.

The use of the term "at least one" may mean only one in certain circumstances.

The principles of the invention will now be described by a detailed description of at least one drawing relating to exemplary features of the invention. It is clear that other arrangements can be configured according to the knowledge of persons skilled in the art without departing from the underlying concept or technical teaching of the invention, the invention being limited only by the terms of the appended claims.

FIG. 1*a* shows an exploded view of a dispenser 101. The dispenser 101 comprises a housing 109 into which a roll of sheets 103 is insertable. The roll of sheets 103 may be loaded onto a spindle 111 configured to engage with the housing 109 such that the roll of sheets 103 is rotatable within the housing 109. The spindle 111 has two open slots 112 suitable for locating a finger and thumb to enable an operative to hold the spindle with one hand when removing and/or replacing a cartridge 103, and enabling the use of the other hand to manipulate the cartridge 103 on or off the spindle 111. A key lock 114 is shown located in a suitable position on the housing. In this example, the key lock has a rotating latch which engages and disengages with the spindle such that the spindle may only be manipulated when the key lock is in an 'unlocked' position, thereby keeping the contents of the dispenser secure from unauthorised persons in a 'locked' position.

The housing has a pivoting lid 119 that serves two purposes: to provide access to the interior of the housing 109 for maintenance/repair and/or securing the housing to the securing plate 113 (discussed below); and to provide the display area 107. The lid 119 may be transparent such that literature may be placed beneath the lid 119 (for instance held in place by lid backing plate 119*b*, also pivotable).

The housing 109 may be removably couplable to the securing plate 113. In the present embodiment, this is achieved by two slide-on clips 115 and a locating peg 117; however, other systems are also envisaged. The securing plate 113 is more robustly couplable to the fuel gun, for instance by a two-part clamp. A clamping part 121 may be secured to corresponding brackets 123 on an underside of the securing plate 113, in order to clamp the dispenser around the grip 11.

A retaining bracket 125 is also provided for preventing axial movement of the dispenser along the fuel gun; in particular, the retaining bracket is configured to wrap around part of the trigger and/or trigger guard/handle frame 14. The retaining bracket 125 prevents rotational, directional and/or angular movement of the device in relation to the nozzle.

Both the clamping part 121 and the retaining bracket 125 may be configured to be adjustable in order to fit a variety of fuel gun configurations, for instance by having holes with oval cross sections for insertions of bolts therethrough.

The clamping part 121 and/or retaining bracket 125 may utilise and/or replace a handle frame fastening bolt and fastening nut found on many types of nozzle, in order to more securely attach to the handle frame.

The retaining bracket 125 may be configured to make the use of a trigger catch impossible; that is, the retaining bracket may sit on the fuel gun in the location of a trigger catch.

The retaining bracket 125 and/or clamping part 121 may be configured to wrap partially or fully around the handle frame 14 to have the advantage of requiring no fasteners, either new components or those existing within the nozzle. The combination of the retaining bracket 125 and/or clamping part 121 when connected will prevent any rotational, directional and/or pivotal movement of the device in relation to the nozzle in any plane or angle.

In the present example, the housing 109 is placed flush against the securing plate 113, with two guide ridges 115 on the securing plate 113 entering slots on the underside of the housing 109. The housing 109 is then moved back to engage with the guide ridges 115 which then prevent any movement separating the housing 109 from the securing plate 113.

FIG. 1*b* shows the dispenser 101 releasably attached to a fuel gun 2 by a secure connection to the rear of the grip 11 of the gun 2. A user may remove a sheet of protective barrier material 103 from a horizontal slot 105 in a rear part of the dispenser 101. An indicator arrow 106 is provided to aid the user in identifying the direction of retrieval of the barrier material 103. Advertising literature and/or instructions for use may be placed in the display area 107. The present form of dispenser is such that it does not interfere with the act of operating the nozzle to dispense fuel.

FIG. 1*c* shows detail of the spindle 111 and key lock 114, separate from the housing 109. Rotation of the key lock 114 allows a locking tab 116 to engage with the spindle 111 to prevent rotation of the spindle 111. In alternative arrangements the key lock may be of a sliding latch, push-in/out latch, spring-loaded latch, hinged latch, or similar type. In further alternative arrangements, the key lock may be located within the spindle itself, thus engaging and disengaging with the surrounding housing or other surrounding body. As an alternative to the two open slots 112 in the spindle 111, slots of a size and shape unsuitable for manipulation with fingers/thumbs may be used so that only a key (either bespoke or off-the-shelf) can be used to manipulate the spindle 111, preventing the insertion of fingers and the subsequent unauthorised manipulation of the spindle 111.

The spindle 111 may be of any form onto which a roll of barrier may be fitted. The spindle may be provided with a handle that may be gripped by a user when putting the roll of barrier on, or taking it off.

FIG. 1*d* shows a modified dispenser 101 releasably attached to a fuel gun 2 by a secure connection to the rear of the grip 11 of the gun 2, where similar reference numerals are used to refer to similar elements to those shown in FIGS. 1*a*, 1*b* and 1*c*. A user may remove a sheet of protective barrier material 103 from the horizontal slot 105 in the rear part of the dispenser 101. Advertising literature and/or instructions for use may be placed in the display area 107. The present form of dispenser is such that it does not interfere with the act of operating the nozzle to dispense fuel.

FIG. 1*e* shows an exploded view of the dispenser 101 of FIG. 1*d*. The dispenser 101 comprises a housing 109 into which a roll of sheets 103 is insertable. The roll of sheets 103 may be loaded onto a spindle 111 configured to engage with the housing 109 such that the roll of sheets 103 is rotatable within the housing 109. The housing has a pivoting lid 119 that serves two purposes: to provide access to the interior of the housing 109 for maintenance/repair and/or securing the housing to the securing plate 113 (discussed below); and to provide the display area 107. The lid 119 may be transparent such that literature may be placed beneath the lid 119 (for instance held in place by lid backing plate 119*b*, also pivotable).

The housing 109 may be removably couplable to the securing plate 113. In the present embodiment, this is achieved by two slide-on clips 115 and a locating peg 117; however, other systems are also envisaged. The securing plate 113 is more robustly couplable to the fuel gun, for instance by a two-part clamp. A clamping part 121 may be secured to corresponding brackets 123 on an underside of the securing plate 113, in order to clamp the dispenser around the grip 11.

A retaining bracket 125 is also provided for preventing axial movement of the dispenser along the fuel gun; in particular, the retaining bracket is configured to wrap around part of the trigger and/or trigger guard/handle frame 14. The retaining bracket 125 prevents rotational, directional and/or angular movement of the device in relation to the nozzle.

Both the clamping part 121 and the retaining bracket 125 are configured to be adjustable in order to fit a variety of fuel gun configurations, for instance by having holes with oval cross sections for insertions of bolts therethrough.

The clamping part 121 and/or retaining bracket 125 may utilise and/or replace a handle frame fastening bolt and fastening nut found on many types of nozzle, in order to more securely attach to the handle frame.

The retaining bracket 125 and/or clamping part 121 may be configured to wrap partially or fully around the handle frame 14 to have the advantage of requiring no fasteners, either new components or those existing within the nozzle. The combination of the retaining bracket 125 and/or clamping part 121 when connected will prevent any rotational, directional and/or pivotal movement of the device in relation to the nozzle in any plane or angle.

The clamping part 121 may be connected by fasteners, clips, protrusions, bolts, nuts, threaded inserts or similar fixings. The clamping part 121 may have teeth, ridges and/or protrusions on an internal surface to improve resistance to movement between the clamping part 121 and the handle 11. The internal surface may also be coated in a relatively high-friction material (compared to the exterior surface), such as a rubberised coating, or utilise an insert of suitable material to provide additional grip to the handle.

The clamping part 121 may secure onto the handle 11 and/or the breakaway coupling to attach to the nozzle. In this example the clamp only makes contact with the handle, with a suitable gap between the clamp and breakaway coupling so as not to contact or interfere with the operation of the breakaway.

The clamping part 121 may contain a threaded insert (e.g. made of metal) on one half of the clamp to enable a fastener on the other half to engage and provide a high torque to attach the device to the handle. Plastic-tapping fasteners may also be used either alternatively or additionally.

The clamping part 121 has protrusions on an interior surface, arranged to increase friction between the clamping part 121 and the handle, thereby preventing the device from rotating around the handle. In addition, pivoting around the handle frame is prevented with the retaining bracket 125.

The clamping part 121 and the retaining bracket 125 are configured to be adjustable in order to fit a variety of fuel gun configurations, for instance by having holes with oval cross sections for insertions of bolts therethrough.

It is envisaged that the two-part clamp (comprising the clamping part 121 and the corresponding bracket 123) may be orientated in various different planes from that shown. For instance, the two-part clamp may have two side-orientated halves as opposed to an upper and lower half. In such an arrangement, an upper clamp may be used to sit over the two side-oriented halves to act as a bridging and/or connecting piece between the two side-orientated halves. As with the clamping part 121 and the corresponding bracket 123, the side-orientated halves may use fasteners, clips, bolts and/or threaded nuts to secure the two halves together.

The securing plate 113 may have other forms of suitable slots and protrusions to act as guides and locating members to enable the dispenser to connect to the upper clamp in a uniform and easy-to-use manner. Fasteners, clips, bolts, nuts and/or threaded inserts may be used to provide a secure attachment for the housing 109 to the securing plate 113. In the present example, the housing 109 is placed flush against the securing plate 113, with two guide ridges 115 on the securing plate 113 entering slots on the underside of the housing 109. The housing 109 is then moved back to engage with the guide ridges 115 which then prevent any movement separating the housing 109 from the securing plate 113.

The locating peg 117 may comprise a threaded internal bore or threaded insert into which may be received an externally threaded fastener (e.g. a bolt or screw). The fastener may be passed through a hole in the housing to cooperatively engage with the threaded internal bore, and the fastener may have an enlarged head, for instance, to clamp the housing 109 onto the securing plate 113. Other arrangements are also considered, including key or combination operated locks. The fastener may be accessible only through the housing; that is, when the lid 119 is open, therefore preventing unauthorised removal of the housing 109 from the securing plate 113.

The housing 109 may be formed as a complete unit, or alternatively the housing 109 may be constructed from one or more pieces; for instance, a lower and an upper housing portions, which may be coupled together using fasteners, clips, protrusions, bolts, nuts, threaded inserts, or any other suitable means.

The dispenser 101 is suitably angled and positioned away from the handle and merges into the existing form and shape of the handle to allow ease of nozzle use, such that operation of the nozzle, and gripping of the handle 11 are not affected.

The dispenser 101 may also act as a protective cover to the breakaway coupling without interfering with the coupling's operation.

The dispenser in this example shows a cartridge in the form of a roll of paper sheets 103 which are retrieved and pulled down from the base of the dispenser 101. The dispenser 101 could be configured so that the dispensed materials can be pulled up or pulled out, and/or pulled sideways or in any orientation from the dispenser 101.

As mentioned above, the lid 119 may be a viewing window (e.g. transparent) that may take several alternative forms, including a hinged window (shown), a sliding window, a clip-in and clip-out window, or a combination of any of these. Alternatively or additionally, the lid 119 may comprise a suitably sized and shaped protrusion from its underside which covers the cartridge access port in housing 109 when the lid 119 is in its closed/locked position, and uncovers the cartridge access port in the housing 109 when the lid 119 is in its fully open/unlocked position, preventing unauthorised access to the housing 109. The lid 119 may be sealable to substantially inhibit water ingress. The lid 119 may contain a finger slot(s) and/or tool slot(s) to facilitate ease of opening; it may require an off-the-shelf or bespoke tool to open. Alternatively or additionally, the lid 119 may use fasteners, bolts, nuts, threaded inserts, protrusions, hooks, clips, slots and/or nubs to locate and releasably attach the viewing window to the dispenser housing 109.

The lid 119 may contain suitable slots and/or protrusions to support information/advertising literature (e.g. a card) close to the underside surface for the most effective display. For instance, it may utilise a sticker or card slot provided to display fuel type, information and/or advertising. The lid 119 may be releasably attachable and therefore replaceable.

The lid backing plate is optional, but where used may be coupled to the lid 119, by means of a combination of suitable hinges, clips, fasteners, protrusions, nubs and/or slots. The lid backing plate may be surrounded by a lip which protrudes from the underside of the lid 119. This lip follows the form of the lid backing plate and may contain a seal. When the lid 119 is closed, the sealed lip provides resistance to water and/or moisture ingress, thus protecting any advertising and/or information card contained within. The housing 109 may comprise biasing means for pushing the lid backing plate (and therefore the sealing lip) against the lid 119.

In various alternative arrangements, the cartridge may take several different forms such as: a roll; layered sheets; folded or multi-folded sheets; and/or bundled sheets.

The barrier material to be dispensed may comprise: paper, such as waxed paper, plastics membrane material; disposable gloves and/or bags; disposable hygienic wipes; sanitising agents, cleansing gels, fluids, crystals and/or powders; or any other form of barrier material.

In alternative arrangements, the cartridge may be front-loaded, top-loaded through a window, side-loaded through a locking cap, bottom-loaded through an opening cap; the cartridge and its contents could be configured to be retrieved from any orientation from the dispenser.

The cartridge may be provided with an outer sleeve such as a light card or plastic packaging film or casing. The outer sleeve, film or casing may be printed with information and/or advertising. The barrier material may be printed with information and/or advertising. The cartridge and/or its outer sleeve and/or the barrier material may have anti-static properties. The cartridge and/or its outer sleeve and/or the barrier material may be recyclable. The cartridge contents may be used to provide a protective barrier to prevent the contact between a user's hands and the nozzle handle and/or trigger lever.

The cartridge contents may be suitably sized to provide a suitable barrier preventing the hands from touching handle, trigger lever or other area. The dispenser in this example is suitably sized to house a cartridge roll of paper material of a width and length suitable to provide a barrier between the user's hands and the handle and/or trigger lever of the nozzle. The cartridge contents, such as sheets, gloves and/or bags, may be coupled together such that pulling one begins to pull the next one; however, the coupling may be perforated to aid separation.

The housing 109 may be configured to house the cartridge at the base, top or side of the housing 109, or in any other suitable position, in order to provide a better viewing window angle and/or size, and in order to make retrieval of the contents as easy as possible.

The dispenser retrieval slot 105 may take alternative forms, such as: a round hole; a broad elongate open slot to enable users to manipulate contents of the dispenser with their fingers and thumbs; a narrow elongated slot to prevent users from manipulating contents of the dispenser with their fingers thumbs other than to retrieve a single sheet; and/or a smooth, serrated, toothed and/or sharp edging to assist the user with sheet separation.

The dispenser may incorporate a slot suitably positioned (for instance substantially at right angles to the dispenser retrieval slot 105) to enable the operative to easily see how much of the dispenser contents are remaining to ascertain whether there is a need to refill the dispenser without having to open it.

Optionally, to achieve the same result, the dispenser may comprise an indicator to highlight a near-empty or empty cartridge. Such an indicator could be in the form of: a different colour to the disposable hand protection as it nears-empty, such as the last 10 pieces of hand protection being coloured red; a coloured piece of material connected to the core of the roll of barrier material, such that when the last piece of hand protection has been taken the material falls with gravity to indicate the cartridge is empty. It may also have printed on it words such as 'Please refill'; a hinged flap (such as a live hinge) connected to the internal form of the dispenser casing, or to one of the other internal components (such as the cartridge spindle). This flap would rest on the upper surface of the cartridge, and which would then flop down with gravity when the cartridge is depleted, and protrude from the opening in the dispenser indicating a refill is required; and/or a sprung catch, optionally brightly coloured and which may stick out when the cartridge nears-empty.

FIG. 2*a* shows a first variation of the mechanism for coupling the housing 109 to a fuel gun. The securing plate 113 is substantially the same as that in FIGS. 1*d* and 1*e*; however, the securing plate is coupled to a handle shroud 131, which can be configured to either cover the existing handle shroud of a fuel gun, or replace the existing handle shroud of a fuel gun.

The handle shroud 131 may be moulded as one part, from substantially resilient material such that it can be manipulated over the handle of a fuel gun. A T-slot in the handle clamp assembly assists flexibility of the handle shroud 131, and accepts a trigger and/or trigger support frame of a fuel gun therein.

FIG. 2*b* shows an alternative arrangement in which the securing plate 113 and the handle shroud 131 are formed in two parts, couplable along a longitudinal axis. In alternative arrangements, the handle clamp assembly may be configured to be constructed from more than two parts, as well as from a different orientation, such as top and bottom, or front and back.

Shown are a plurality of connecting portions 133 for securely coupling the two halves together. In alternative arrangements, there may be at least one suitable protrusion to enable the two halves to interlock with one another. There may be at least one male protrusion on one half with a corresponding female receptor on the other half to enable the two halves to interlock. There may be at least one fastener and/or nut arrangement used to enable the two halves to interlock. The handle clamp assembly may also use clips, protrusions, nubs, slots, to enable the two halves to interlock.

In this example the two halves wrap around the handle and handle frame, and do not need to use the existing fasteners and nuts already located on the fuel nozzle. The device, however, may be configured to use at least one of these fasteners and/or nuts already existing on the nozzle to provide additional security for the attachment. The device can be configured to either cover the existing handle shroud of a fuel gun, or replace the existing handle shroud of a fuel gun.

The handle shroud 131 may comprise plastics material and/or metal, and/or a material which also contains an antibacterial property, such as silver.

FIG. 3 shows a dispenser 135 releasably attached to a fuel gun to the rear of the handle 11, and forward of the breakaway coupling, by a secure connection. The dispenser 135 receives a similar roll of barrier material 103 received on a spindle 111 similar to the arrangement of FIGS. 1*d* and 1*e*. However, in this arrangement, the lid 137 hinges along a line distal from the roll of barrier material 103. A key 139 is provided to assist removal of the roll barrier material 103 and/or the spindle 111, as is discussed below.

Turning to FIG. 4, which shows the dispenser 135 separate from the fuel gun 2, the dispenser 135 comprises a substantially 'horse-shoe' shape or 'U' shape connector 141 for coupling the housing 140 to the fuel gun. The connector 141 may be passed around a handle of the fuel gun, and secured with a clamp 143 that connects the open ends of the U shape together. The connector 141 may comprise a retaining bracket 125 for securing the clamp 143 to the trigger or trigger guard of the fuel gun. In this way, the connector 141 may substantially inhibit radial movement of the dispenser 153 away from the handle, and the retaining bracket may substantially inhibit rotational movement of the dispenser 135 around the handle and axial movement along the handle.

The connector 141 and clamp 143 may be formed from a plurality of components which secure together to wrap around the handle frame and sit against the underside of the handle. This assembly may make use of, or replace, the existing nut and/or fastener which exist in most types of nozzle and are used to attach the handle frame to the handle body. The components may be made from a plastics material and/or metal.

FIG. 5 shows detail of the locking spindle 111 and key 139 discussed above. The key 139 has a handle 145 for manipulation by a user, and teeth 147 for engaging with recesses 149 in the spindle 111. Locking members 151 on a perimeter of the spindle 111 engage with the housing of the dispenser in question, to prevent accidental removal of a roll of barrier material 103 inserted therein.

FIG. 6 shows a variation in which the key 139 comprises two prongs 153 that engage recesses 155 in the spindle 111. In alternative arrangements, instead of a twist-lock arrangement, the spindle 111 may be secured by a hinged cap or flap, a screw-type cap, a clip-in and clip-out cap, a sliding cap, a spring-loaded cap, or similar means.

An optional feature (not shown) comprises a flexible component suitably formed and sized to provide a degree of resistance when the spindle is twisted to engage and disengage. The feature is configured to allow the operative to clearly feel when the twist lock has fully engaged, as well as helping to prevent unauthorised removal without the correct tool. It may be made of a plastics material or metal. It may be a feature formed in the dispenser, while in this example it is a separate component which slots into the dispenser.

An alternative key is proposed that comprises two elongate projections, disposed parallel to one another, and spaced apart by a predetermined distance. The key may include a hoop (e.g. a ring) for passing a finger therethrough, connecting the two elongate projections together. The elongate projections may be substantially straight. The two projections may be used by inserting them into correspondingly-spaced holes on the dispenser and/or coupling. Pressure applied by the elongate projections activates at least one catch within the dispenser. The key may be used to remove the housing from the coupling and/or for opening the housing.

FIG. 7 shows a rear view of the arrangement shown in FIGS. 3 and 4, in which can be seen the serrated elongate opening for removing the barrier material.

FIG. 8 shows a dispenser 159 configured such that the axis of the roll of barrier material 103 and the spindle 111 is substantially parallel to the axis of the fuel gun when in use. The means for connecting the dispenser to the fuel gun is similar to that shown in FIGS. 3, 4 and 7.

FIG. 9 shows a modification of the dispenser 135 of FIGS. 3, 4 and 7 in a similar manner as the modification of FIGS. 1*d* and 1*e*, in FIG. 2*a*. That is, FIG. 9 shows a dispenser 161 couplable to a handle of a fuel gun with a handle shroud 163. The handle shroud 163 may be configured to replace the existing plastic handle shroud on a fuel gun and therefore the device itself becomes the handle shroud. Alternatively, the handle shroud 163 may be configured to overlay the handle shroud of an existing fuel gun to which it is to be attached.

The handle shroud 163 may be integrally moulded with the dispenser 161 housing as one piece, or alternatively the dispenser 161 may be formed as a number of separate components which releasably attach together to form the device. The attachment may be in the means of fasteners, slots, nubs, protrusions, sliders, and/or clips, and may be installed with a rotational, pivotal, sliding and/or directional movement. Suitable protrusions and/or slots may be moulded into the handle shroud 163 so as to aid the user with gripping the device.

Optional sheet holding clips 165 are moulded to or separately attached to the handle shroud 163 and/or the dispenser component to aid a user in releasably attaching a retrieved sheet to the handle and allow the user to temporarily release the sheet without the sheet falling or blowing away.

FIG. 10 shows a further variation in which a dispenser 167 is attached in the area of the nozzle head, connected to the nozzle by a bracket arrangement 169 suitably sized and formed to fit over already existing protective covers, sheaths, shrouds and/or advertising and display units. This bracket arrangement prevents the full covering of the shroud, sheath, protective cover, advertising or display unit and its advertising, thereby offering the advantage of a dispenser located in a desired area, while allowing full functionality of the existing devices that may already be attached to the nozzle. The device may use one or more bracing members to provide stability.

FIG. 11 is a perspective view of a dispenser 1 in use on a fuel gun 2. The dispenser 1 contains a plurality of pieces of barrier material 3 therein, accessible to a user via a slot 5. The fuel gun 2 comprises a nozzle 9, hand grip 11, trigger 13 and hose connector 15 (to which a flexible fuel hose is connectable).

FIG. 12 shows the dispenser 1, with a piece 7 of the plurality of pieces 3 removed and wrapped around the hand grip and trigger of the fuel gun 2.

FIG. 13 is a perspective view of the dispenser 1, detached from the fuel gun and with no pieces contained within. The dispenser 1 comprises a main body 17 which is connectable to the fuel gun via a coupling member in the form of a retaining loop/band 19. The retaining band 19 comprises a resilient plastics material (but could additionally/alternatively comprise an open- or closed-cell foam and/or metal) that is configured to loop around the nozzle of the fuel gun to prevent radial movement from the axis of the fuel gun. The retaining band 19 is removably attached to the main body 17, to be described in more detail later; however, in other embodiments, it may be fixedly attached, for instance integrally formed therewith.

Also attached to the main body 17, and in some embodiments integrally formed therewith, is a locating member, in the form of a cup-shape portion 21. The cup-shape portion 21 comprises a substantially flat plate arranged at an oblique angle to the retaining band 19 and a peripheral flange around the edge of the plate. The cup-shape portion is configured to sit on a round badge/protrusion between the hand grip 11 and the nozzle 9 of a typical fuel gun 2. The flange prevents slippage on the round badge/protrusion. Due to the oblique angle (e.g. between 30 degrees and 60 degrees, for instance 45 degrees) of the cup-shape portion 21 relative to the retaining band 19, when assembled in place on a fuel gun movement of the dispenser 1 is substantially inhibited.

The slot 5 is shown with a large open portion in the lower face of the main body 17 and a small open portion in the front face of the main body 17. This allows a user to efficiently remove pieces from the dispenser 1. A large indicating arrow 23 on the front face of the main body 17 directs a user to the slot 5. In some embodiments, the indicating arrow 23 is a further slot, which may be separate from (or contiguous with) the slot 5. In this way, the arrow 23 and slot 5 can also be used to visibly determine the quantity of remaining protective pieces, thus providing the fuel station forecourt operator with an indication of when to refill or replace a cartridge.

The main body 17 is constructed from two components which are slidably coupled together, as discussed in more detail below.

FIG. 14 is a further perspective view of the dispenser 1 shown in FIG. 13, showing additional details of the retaining band 19, the cup-shape portion 21 and the main body 17. A lock 25 on the main body 17 selectively enables slidable coupling of the two components of the main body 17 referred to above. A ridged region 27 provides an increased resistance to rotational and/or axial movement of the dispenser 1 around the nozzle 9.

FIG. 15 shows detail of the detachable retaining band 19. In (a) the retaining band 19 is shown detached from the main body 17, in particular showing two resilient tongues 29 with hooks disposed on a free end thereof. In (b), a lower one 31 of the two components of the main body is shown, wish the tongues 29 projecting through slots in the base of the lower component 31.

To couple the retaining band 19 to the lower component 31, the tongues are merely inserted into the slots and the hooks maintain it in place. The tongues may be of a suitable length, height and width and configuration to provide an optimal securing arrangement for the dispenser housing on to the retaining loop/band/body. In some preferred embodiments, fasteners (e.g. plastic and/or metal), for instance nuts and bolts, may be provided to enable further security and prevention of movement away from the fuel gun body. To decouple the retaining band from the base of the lower component 31, access to the interior of the main body 17 is required, and the tongues 29 must be biased apart to disengage the hooks.

FIG. 16 illustrates the opening and locking mechanism of the main body 17 of the dispenser 1. In (a), an upper one 33 of the two components is shown sliding onto the lower component 31, on rails 35. Optional tabs 37 are shown on the upper component 33 for engagement within receiving holes 39 on the lower component 31. In some embodiments, the tabs must be manually disengaged by a user before the upper component 33 may be removed from the lower component 31. Alternatively or additionally, the tabs may engage with the receiving holes 39 to provide a pivoting connection between the upper component 33 and the lower component 31. In this way, the upper component 33 may be pivoted about the hooks 37 to open and close instead of sliding along the rails 35 (rather, the rails may be used merely as locating devices to ensure secure closure). The tabs may be configured to enable the upper component 33 to be detached from the lower component 31 when the angle between the two components is large, for instance, greater than 90 degrees. For instance, the tabs may be in the form of hooks. In this way, the upper component 33 may be separated from the lower component 31, for instance, to replace the upper component in the event of damage.

It is appreciated that other configurations of main body 17 are possible, such as having a box with a hinged opening on the top and/or side. The main body may be suitably shaped, sized and angled to offer ease-of-use when locating and manually manipulating the fuel gun into a vehicle's fuel receptor.

In (b) a cross-sectional view inside the assembled main body 17 is shown, looking at the lock 25 from the inside. The lock 25 moves an engagement arm 26 into a receiving part 32 on the lower portion 31 to prevent slidable movement of the upper portion 33 relative to the lower portion 31. A locking feature is preferable to prevent unauthorised access into the dispenser housing.

In FIG. 16, the upper surface of the main body is shown to include a window 41 so that the contents of the dispenser 1 can be readily assessed (in particular the quantity of remaining pieces). In such arrangements, advertising and/or instructional information may be provided on the pieces within the dispenser. For instance, instructions on use and/or the type of fuel to be dispensed. In alternative embodiments, any such information may be provided directly on the upper surface of the main body 17.

In an alternative embodiment, instead of the pieces being contained directly within the main body 17, they may be retained within a cartridge that may be inserted into the main body 17 for ease of refilling.

FIG. 17 shows a further alternative dispenser 49 (a) in perspective view in use on a fuel gun 2, this time showing a portion of the hose 47, (b) as an exploded view detached from a fuel gun, (c) shows the dispenser 49 in use with an optional sheet retaining clip, and (d) is an exploded view of a variant discussed below.

The dispenser 49 comprises a roll of perforated sheets (in a similar manner to toilet and/or kitchen paper), each sheet 53 being removable via slot 51. The roll of perforated sheets may be replaced by insertion through access port 55, which can be releasably locked and/or secured in place.

The dispenser 49 comprises an upper part 43 into which the roll of perforated sheets 53 can be inserted axially, using locking spindle 44. Upper part 43 includes a pivoting top plate 45 onto which (or behind which in embodiments where the top plate 45 forms a transparent viewing window) can be affixed advertising literature, instructions, etc. The upper part 43 is couplable (for instance removably couplable) to a lower part 46 that is configured to be attached to a fuel gun. The coupling may be via any suitable fixing means, for instance bolts as shown (the threading of the bolts has not been shown, for clarity).

The dispenser upper part 43 contains slots, protrusions, clips and/or nubs suitable to engage the viewing window or top plate 45, which may act as bump stops to prevent over-pivoting. The dispenser upper part 43 may also contain open slots (not shown) to allow the operative to view the remaining contents of dispenser without opening the dispenser 49. The dispenser 49 may be constructed from one or more separate components releasably connected by suitable clips, fasteners, bots, nuts, threaded inserts, protrusions, and/or nubs.

The upper part 43 and lower part 46 may be coupled together around the fuel gun 2, in particular the nozzle, and may optionally engage with the trigger guard adjacent to the handle. The dispenser body may use at least one existing fastener and/or hole which already exists within the nozzle to secure the dispenser body to the nozzle body, handle and/or handle frame. The internal form of the dispenser body could be shaped to take the form of a portion of a desired fuel gun either including or excluding the protective plastic sleeve that exists with most types of nozzles, to provide a close and secure fit to the nozzle.

The dispenser 49 may be made of a plastics material in combination with rubber, synthetic rubbers and/or metal.

The internal dispenser compartment may be fully or partially split into two separate compartments, one to house the cartridge, and one to house the information card, this is so that if water or moisture ingresses into the cartridge compartment it is prevented from entering the compartment for the information or advertising card.

This example shows a cartridge in the form of a roll of paper sheets which are retrieved and pulled down from the base of the dispenser. Alternatively, the dispenser 49 could be configured so that the dispensed materials can be pulled up or pulled out, and/or pulled sideways from the dispenser.

FIG. 17*c* shows a clip 47 located on the dispenser 49 for holding a sheet of barrier material (not shown) in place on the handle of the fuel gun 2. An optional further clip 47 is provided on a collar 48 around the handle of the fuel gun 2, distal from the dispenser 49. In this way, a sheet may be temporarily held in place on the handle. Either clip 47 may be releasably attached to the handle, the handle frame, coupling, or nozzle-head protective sleeve. The clips 47 may be made of plastics material or metal. The clip 47 may alternatively or additionally take the form of a spring clip, roller, protrusion, slot and/or a fastener, or a combination of any of these.

FIG. 17*d* shows a variant of the dispenser 49 in which the roll of perforated sheets 53 is replaced with a fluid sanitiser reservoir 451, for use in dispensing a hygienic sanitiser to cleanse the hands. The fluid may be liquid, foam or gel. The reservoir 451 may be manufactured from plastics and/or paper/card material, may be of a rigid form or soft and flexible form such as a pouch, and may have a shape, size and form suitable to be housed in a dispenser of a suitable shape, size and form.

The reservoir may contain a built-in dispensing mechanism; however, in the present example, a separate mechanism 453 is installed, the mechanism 453 comprising a lever 455 arranged to project out of the upper part 43' and for manipulation by a user, and a pressure part 457 for engaging with a spout 459 of the reservoir 451, which projects out of the upper part 43' through hole 461. Depression of the lever 455 rotates the mechanism 453 about pivot axis 456 to activate the spout 459 with the pressure part 457, causing fluid to be released from the reservoir. This mechanism may be, for example, spring-loaded.

The reservoir may be pressurised so as to release some of its contents when activated. Alternatively, the reservoir may use a gravity feed to release its contents. The reservoir may use a spring mechanism which when pressed will release some of the contents, and then return to its resting position, such as like a domestic hand soap dispenser.

In alternative arrangements, the reservoir may be front-loaded, top-loaded through viewing window, side-loaded through a locking cap, bottom-loaded through an opening cap into the dispenser; in particular, the reservoir and its contents could be configured to be retrieved from any orientation from the dispenser.

The reservoir may have an outer sleeve such as a light packaging film or casing. The outer sleeve may be printed with information and/or advertising. The reservoir and/or its outer sleeve may have anti-static properties, and may be recyclable.

The reservoir contents may be used to provide a sanitising, hygienic and/or cleansing agent, fluid and/or gel to cleanse the hands before or after contact with the fuel nozzle assembly such as the handle and/or trigger lever.

The dispenser may be configured to house the reservoir at the base, top or side of the dispenser, or in any other suitable position, in order to provide a better viewing window angle and/or size, and in order to make retrieval of the contents as easy as possible.

The upper part 43' is configured to receive and house a reservoir of sanitiser. It may incorporate clips, protrusions, nubs, slots, fasteners, springs, levers, sliders to locate the reservoir in its position within the dispenser.

The dispenser sanitiser retrieval slot may take several different forms, such as: a round hole 461 as in the present example; a large elongated open slot to enable users to manipulate contents of the dispenser with their fingers and thumbs; or a small elongated slot to prevent users from manipulating contents of the dispenser with their fingers and thumbs other than to retrieve the reservoir contents. The retrieval slot may be located on any suitable surface of the dispenser, in order to give the user the most practical and easy-to-use means of operating the device.

The dispenser may incorporate a slot suitably positioned to enable the operative to easily see how much of the dispenser contents are remaining to ascertain whether there is a need to refill the dispenser without having to open it.

The dispenser could also be shaped to receive a different shaped viewing window such as to create a larger space for information and/or advertising. This could take the form of a rectangle, square, circle or other suitable shape.

The mechanism may be an activation trigger, which in the present example is manually operated, but could conceivably be automated or electronically controlled. The activation trigger may take many forms such as a push button, a spring button, a push lever, a pull lever, a push slider, a pull slider, a hinged lever and/or a spring lever.

The activation trigger may be hinged within the dispenser casing and/or attached to the dispenser casing by other suitable means, such as clips, protrusions, fasteners, pins, springs. The activation trigger mechanism may be constructed of at least one component to perform the required motion in order to release some of the reservoir contents.

There may be only one, at least one or more than one activation trigger. The device may be configured so that the operation of any one of these levers activates the reservoir, or it may require both levers to be operated simultaneously.

The activation trigger could be configured to be located anywhere suitable on the dispenser, such as on its side, base, top, front faces, to make operating the device as user-friendly as possible.

FIGS. 18*a* and 18*b* show a dispenser 501 in which a separate top flap 503 is used as the means of opening and closing the dispenser when inserting and removing the information and/or advertising card (not shown). An advantage of this is that the viewing window can be secured to the dispenser and not undergo regular opening and closing which may in time cause damage to its hinge, securing mechanism and/or transparency properties, which may reduce the quality of the displayed information.

The top flap 503 opening mechanism may take the form of a hinged flap (as in FIG. 18*a*, shown open), a slider with runners 504 in grooves 506 (as in FIG. 18*b*, exploded view) or clip-in and clip-out flap (not shown).

A sticker or card may be provided to display the fuel type, information and/or advertising on the top flap 503, or the top flap 503 may be embossed with the fuel type.

The top flap may optionally comprise: a finger slot or tool slot to assist in opening the flap 503; suitable slot(s), nub(s) and/or clip(s) to secure in place; a seal to prevent water ingress; transparent material.

FIG. 19 shows an arrangement in which a dispenser 471 is configured to dispense protective barrier sheets and a hygienic sanitising cleansing agent, fluid, foam or gel. In this arrangement a fluid reservoir 473 is included within the upper housing 475, which is couplable to a lower housing 477 by means described above. A barrier material 479 is dispensed in a similar arrangement to that described above. In this example a feed pipe 481 from the reservoir 473 passes underneath of the barrier material 479, and is activated with mechanism 483 as described above.

The arrangement may be altered to be configured in any other way, such as the sanitising cartridge at the base and the barrier cartridge at the top, or both cartridges positioned side-by-side, or on top of one another.

The sanitising cartridge may have a suitably long dispensing spout (i.e. feed pipe 481) to travel through the dispenser to a dispensing hole at a suitable location for user-friendly operation. In this example the spout travels through a wall which separates the two cartridge compartments, under the barrier cartridge and to the side of the nozzle body. The retrieval hole is then located near the retrieval slot for the barrier sheets.

FIG. 20 is a perspective view of a dispenser for attachment directly to the hand grip of a fuel gun. This dispenser comprises a base 66 and a cartridge 67 with an access region 69 for sliding out a top sheet 71 from a stack of such sheets within the cartridge 67. Such a sheet may be pulled out, and wrapped around the handle for use in the direction indicated by the arrows. Break member 73 may be used to break perforations between sheets, if present; else individual sheets may be used. The cartridge 67 may be a snap fit into the base 66 (by virtue of the cooperating protuberances and depressions 70), or may be fixed with a more secure mechanism. The base 66 can be coupled to the grip of a fuel gun, or may be configured to replace conventional grips used on fuel guns, and may be secured in a conventional manner, or any other manner described herein.

An off-the-shelf or bespoke tool may be used to release the dispenser from the clamp base. Once the dispenser is attached, an elongated retrieval slot allows a user to slide and/or pull a sheet from the dispenser and then wrap around the dispenser, thus providing a protective barrier between a user's hands and the fuel gun. The elongated slot may have a serrated, toothed and/or sharp edging to assist a user in separating a sheet. Once a user has finished using the nozzle, the individual sheet is then removed from the dispenser. Once all sheets have been used and removed, the empty dispenser is then removed from the clamp base and a replacement dispenser is reattached.

FIG. 21 is a perspective view of an alternative dispenser for attachment to the hand grip of a fuel gun. This arrangement differs in that instead of a user being required to extract and use a sheet as a hand grip cover, the sheet 75 is already located on the hand grip, and thus a user must remove and discard a prior sheet before use. The dispenser is hinged about hinge 81 for easy coupling to a fuel gun hand grip. Rotation and movement of the dispenser may be prevented by a clamp around the handle frame and/or the handle. A cartridge system could be used similar to the arrangement in FIG. 20.

FIG. 22 shows a variant dispenser 601 in which the housing 109 of the dispenser 601 is substantially the same as the housing 109 in FIGS. 1*a* and 1*b*, but the housing 109 is couplable to the fuel gun 2 with a modified support body 605 for attachment to the area of the fuel gun 2 between the hand grip 11 and the nozzle outlet 10, such as the nozzle body.

FIG. 23 shows the dispenser 601 of FIG. 22 from the front, with its lid 119 open such that the roll of sheets 103 on the spindle 111 can be seen therein.

FIG. 24 shows an exploded view of the dispenser 601 shown in FIGS. 22 and 23. The support body 605 may be constructed from only one component; however, in this example two components are shown: an upper component 607 and a lower component 609, which are releasably couplable together, for instance with clips, protrusions, recesses, slots, guides and/or fasteners. The support body 605 may alternatively be configured such that the components may be connectable in other orientations, such as two side components, connectable along a vertical plane, or any other configuration to provide a securing arrangement. In order to provide additional stability to the support body to prevent movement away from the fuel gun body, the coupling may also be configured to wrap around and/or releasably connect to at least one portion of the fuel gun body, for instance, the fuel gun nozzle outlet, the trigger hinge/support frame, the protrusion between the hand-grip and the nozzle outlet (i.e. such as the nozzle body), the hose connector, the hand-grip, the trigger lever.

The support body may contain a seal arrangement on the upper and/or lower components to prevent water ingress between the support body components and/or the dispenser. The internal surface of the support body may also substantially copy the form of the fuel gun nozzle body to provide an optimal 'fit' to the fuel gun 2. The external surface of the support body may be configured to provide ease-of-use with construction following the form of the fuel gun and/or the dispenser.

The attachment mechanism to releasably couple the dispenser to the upper component of the support body is substantially the same as the mechanisms discussed above. Thus a 'universal fit' may be provided for the dispenser 101 on a variety of fuel gun configurations, with optional fitment of the dispenser at different areas of the fuel gun, such as the nozzle body, handle grip, hose coupling/connector and/or hose. Other arrangements for the dispenser attachment mechanism are considered, such as clips, nubs, slots, protrusions, recesses, guides, fasteners, key locks and/or combination locks.

FIG. 25 shows a variant dispenser 1001 in which a housing 1003 is configured to dispense sheets of barrier material 1005 through opening 1007. The housing 1003 is coupled, via support body 1009, to fuel gun 2 between the hand grip 11 and the nozzle outlet 10.

FIG. 26 shows the dispenser 1001 of FIG. 25 from the front, located on the fuel gun 2.

FIG. 27 shows a similar view to that of FIG. 26, but with the lid 1011 of the dispenser 103 open, such that a roll 1013 of barrier material 1005 may be seen therein.

FIG. 28 shows an exploded view of the dispenser 1001 shown in FIG. 27. The support gun body 1009 comprises a flat upper surface 1014 onto which the housing 1003 may be clipped (via prongs 1015) and secured (via locking peg 1017 into which bolt 1019 is received). The support body 1009 comprises a sleeve 1021 for receiving the nozzle of the fuel gun therethrough (to prevent radial movement of the dispenser 1001 away from the fuel gun). The support body 1009 also comprises a sheath 1023 for wrapping around a front portion of the trigger guard of the fuel gun to prevent movement of the dispenser 1001 along the nozzle, or rotationally about the nozzle.

The roll 1013 of barrier material 1005 may be placed on a spindle 1025, at one end of which is provided a projecting hand grip 1027, before being inserted into the housing 1003.

Teeth 1029 are provided in the housing, adjacent to access holes 1031, for engagement with a lip 1033 on the inside of the lid 1011. By pushing pins/wire through both of the access holes 1031 simultaneously, the teeth 1029 may be pushed out of engagement with the lip 1033, thereby allowing the lid 1011 to be opened. A suitable tool (not shown) having two parallel (e.g. wire) prongs spaced apart by the same distance as the access holes may be used to conveniently push the teeth 1029 with a one-handed operation. Without such a tool, two hands would be required to manipulate both wires simultaneously.

An inner lid 1035 is provided such that advertising material and/or other literature may be placed between the inner lid 1035 and the lid 1011. In this example, the lid 1011 includes a transparent portion such that the advertising material and/or other literature may be read/observed when the lid 1011 is closed.

The invention claimed is:

1. A protective material dispenser for use with a fuel pump of the kind comprising:

a hose for conveying fuel therein, the hose terminating at a nozzle for insertion into a vehicle's filling inlet; and a hand grip provided adjacent to the nozzle for manual positioning of the nozzle into the vehicle's filling inlet;

the protective material dispenser comprising:

a first coupling configured to be removably securable in a first respective manner to the nozzle, the first coupling provided with a first housing attachment part;

a second coupling configured to be removably securable in a second respective manner to the hand grip, the second coupling provided with a second housing attachment part; and a housing for receiving protective material therein, the housing comprising:

an opening through which at least some of the protective material is removable; and a single attachment mechanism configured to optionally cooperatively engage with either the first housing attachment part of the first coupling or the second housing attachment part of the second coupling, such that the housing is removably securable to each of the first coupling and the second coupling;

such that the housing may be secured via the first coupling, removed therefrom and re-secured to the hand grip via the second coupling.

2. The protective material dispenser of claim 1, wherein the first coupling comprises:

at least one coupling member configured to entirely encircle and wrap around at least one of the hose, nozzle and hand grip, to prevent movement of the housing away from the nozzle in a direction substantially at right angles to an axis of the nozzle; and at least one locating member configured to prevent movement of the housing parallel to the axis.

3. The protective material dispenser of claim 2, wherein the protective material is protective barrier material, and the housing comprises a plurality of pieces of the protective barrier material therein.

4. The protective material dispenser of claim 2, wherein the protective material is sanitising fluid.

5. The protective material dispenser of claim 1, wherein the protective material is protective barrier material, and the housing comprises a plurality of pieces of the protective barrier material therein.

6. The protective material dispenser of claim 1, wherein the protective material is sanitising fluid.

7. A method for protecting a user from contamination due to the fuel pump, the method comprising:

providing a fuel pump of the kind comprising:

the hose for conveying fuel therein, the hose terminating at the nozzle; and the hand grip provided adjacent to the nozzle for manual positioning of the nozzle;

providing the protective material dispenser according to claim 1;

releasably securing the first coupling to the nozzle;

releasably securing the housing to the first coupling;

providing protective material within the housing of the protective material dispenser;

removing at least some of the protective material from the housing through the opening.

8. A method for protecting a user from contamination due to the fuel pump, the method comprising:

providing the protective material dispenser according to claim 1 releasably securing the first coupling of the plurality of couplings of the protective material dispenser to the nozzle;

releasably securing the housing for receiving the protective material therein of the protective material dispenser to the first coupling of the plurality of couplings;

providing the protective material within the housing of the protective material dispenser;

removing at least some of the protective material from the housing through the opening within the housing.

* * * * *